US009340271B2

(12) United States Patent
Morvillo

(10) Patent No.: US 9,340,271 B2
(45) Date of Patent: May 17, 2016

(54) SYSTEM FOR CONTROLLING MARINE CRAFT WITH STEERABLE PROPELLERS

(76) Inventor: Robert A. Morvillo, Dover, MA (US)

( * ) Notice: Subject to any disclaimer, the term of this patent is extended or adjusted under 35 U.S.C. 154(b) by 89 days.

(21) Appl. No.: 13/241,192

(22) Filed: Sep. 22, 2011

(65) Prior Publication Data

US 2012/0135649 A1 May 31, 2012

Related U.S. Application Data

(60) Provisional application No. 61/385,526, filed on Sep. 22, 2010, provisional application No. 61/453,936, filed on Mar. 17, 2011.

(51) Int. Cl.

| | |
|---|---|
| ***B63H 5/125*** | (2006.01) |
| ***B63H 20/08*** | (2006.01) |
| ***B63H 25/42*** | (2006.01) |
| ***B63H 20/12*** | (2006.01) |
| ***B63H 20/00*** | (2006.01) |

(52) U.S. Cl.

CPC ..... *B63H 25/42* (2013.01); *B63H 20/12* (2013.01); *B63H 21/265* (2013.01)

(58) Field of Classification Search

CPC ..... B63H 25/42; B63H 20/08; B63H 20/12; B63H 21/26; B63H 21/265

USPC ..... 440/49, 53, 55, 57, 58, 60, 61 R, 61 S, 440/61 A, 61 B, 61 C, 62, 63, 64

See application file for complete search history.

(56) References Cited

U.S. PATENT DOCUMENTS

| | | | | |
|---|---|---|---|---|
| 2,968,192 | A * | 1/1961 | Fletcher et al. | 74/471 R |
| 2,999,476 | A * | 9/1961 | Johnson | 440/61 R |
| 4,778,418 | A * | 10/1988 | Mondek | 440/63 |
| 6,179,673 | B1 * | 1/2001 | Leroux | 440/65 |
| 6,561,860 | B2 * | 5/2003 | Colyvas | 440/59 |
| 7,037,150 | B2 | 5/2006 | Morvillo | |
| 7,052,338 | B2 | 5/2006 | Morvillo | |
| 7,128,626 | B2 * | 10/2006 | Dudra et al. | 440/63 |
| 7,216,599 | B2 | 5/2007 | Morvillo | |
| 7,222,577 | B2 | 5/2007 | Morvillo | |
| 7,267,588 | B1 * | 9/2007 | Griffiths et al. | 440/63 |
| 7,311,572 | B2 * | 12/2007 | Yamashita et al. | 440/63 |
| 7,467,595 | B1 * | 12/2008 | Lanyi et al. | 114/144 R |
| 7,500,890 | B2 | 3/2009 | Morvillo | |
| 7,527,537 | B2 * | 5/2009 | Mizutani | 440/53 |
| 7,601,040 | B2 | 10/2009 | Morvillo | |

(Continued)

*Primary Examiner* — Daniel V Venne

(74) *Attorney, Agent, or Firm* — Wolf, Greenfield & Sacks, P.C.

(57) ABSTRACT

An apparatus and method for use with a marine vessel having a first steerable propeller and a second steerable propeller is disclosed. The apparatus and method providing for movement of the first and second steerable propellers relative to each other and also maintains a minimum distance between the first and second steerable propellers so as to prevent the first and second steerable from contacting each other. Also disclosed is a control system and method to control the first steerable propeller and the second steerable propeller to provide the fixed distance between the first and second steerable propellers and so as to individually control the first steerable propeller and the second steerable propellers to allow the first steerable propeller and the second steerable propeller to move relative to each other.

9 Claims, 21 Drawing Sheets

(56) References Cited

U.S. PATENT DOCUMENTS

| | | | |
|---|---|---|---|
| 7,641,525 | B2 | 1/2010 | Morvillo |
| 7,972,187 | B2 | 7/2011 | Morvillo |
| 8,126,602 | B2 | 2/2012 | Morvillo |
| 2002/0086594 | A1 | 7/2002 | Colyvas |
| 2004/0005824 | A1 | 1/2004 | Zeiger |
| 2007/0093147 | A1 | 4/2007 | Mizutani |
| 2008/0026655 | A1 | 1/2008 | Gai et al. |
| 2010/0304627 | A1 | 12/2010 | Morvillo |

* cited by examiner

SYSTEM FOR CONTROLLING MARINE CRAFT WITH STEERABLE PROPELLERS

RELATED APPLICATIONS

This application claims priority to U.S. Provisional Application Ser. No. 61/385,526 filed on Sep. 22, 2010, and also claims priority to U.S. Provisional Application Ser. No. 61/453,936, filed on Mar. 17, 2011, each of which is hereby incorporated by reference.

TECHNICAL FIELD

The present disclosure relates to marine vessel propulsion and control systems. More particularly, aspects of the disclosure relate to methods and devices for controlling and allowing marine vessel steering drives to move freely with respect to each other but to also prevent such steering drives from colliding.

BACKGROUND

Various forms of propulsion have been used to propel marine vessels over or through the water. One type of propulsion system comprises a prime mover, such as an engine or a turbine, which converts energy into a rotation that is transferred to one or more propellers having blades in contact with the surrounding water. The rotational energy in a propeller is transferred by contoured surfaces of the propeller blades into a force or "thrust" which propels the marine vessel. As the propeller blades push water in one direction, thrust and vessel motion are generated in the opposite direction. Many shapes and geometries for propeller-type propulsion systems are known.

Other marine vessel propulsion systems utilize waterjet propulsion to achieve similar results. Such devices include a pump, a water inlet or suction port and an exit or discharge port, which generate a waterjet stream that propels the marine vessel. The waterjet stream may be deflected using a "deflector" to provide marine vessel control by redirecting some waterjet stream thrust in a suitable direction and in a suitable amount.

A requirement for safe and useful operation of marine vessels is the ability to steer the vessel from side to side. Some systems, commonly used with propeller-driven vessels, employ "rudders" for this purpose. Other systems for steering marine vessels, commonly used in waterjet-propelled vessels, rotate the exit or discharge nozzle of the waterjet stream from one side to another. Such a nozzle is sometimes referred to as a "steering nozzle." Hydraulic actuators may be used to rotate an articulated steering nozzle so that the aft end of the marine vessel experiences a sideways thrust in addition to any forward or backing force of the waterjet stream. The reaction of the marine vessel to the side-to-side movement of the steering nozzle will be in accordance with the laws of motion and conservation of momentum principles, and will depend on the dynamics of the marine vessel design.

It is understood that while particular control surfaces are primarily designed to provide force or motion in a particular direction, these surfaces often also provide forces in other directions as well. Nonetheless, those skilled in the art appreciate that certain control surfaces and control and steering devices have a primary purpose to develop force or thrust along a particular axis. For example, in the case of a reversing deflector, it is the backing direction in which thrust is provided. Similarly, a rudder is intended to develop force at the stern portion of the vessel primarily in a side-to-side or athwart ships direction, even if collateral forces are developed in other directions. Thus, net force imparted to a marine vessel should be viewed as a vector sum process, where net or resultant force is generally the goal, and other smaller components thereof may be generated in other directions at the same time.

As noted above, a class of marine craft is propelled by multiple steerable propeller drives. FIGS. 1A-1C illustrate various views of a stern/out drive that can be used in combination and FIGS. 1D-1E illustrate various views of a surface drive 111 that can be used in combination as outboard motors. As these terms may be used interchangeably herein, the use of one term shall not imply that the scope of this disclosure is limited to one specific type of drive. The scope of this disclosure includes twin-drive systems, as well as systems comprising more than two drives. A quad-arrangement employing four drives, wherein a pair of drives is installed on each of two hulls of a catamaran hull form, is but one example of a system that can benefit from this disclosure.

A notional single-drive system is depicted in FIGS. 2A-2B, and a notional twin-drive system is shown in FIGS. 2C-2D. The twin-drive system illustrated in FIGS. 2C-2D comprise a port stern drive 205 and starboard stern drive 206 and a mechanical link known as a tie-bar 207. The primary purpose of the tie bar 207 is to prevent the closely-spaced drives 205, 206 from colliding into each other in order to avoid damage to the craft or injury or death to persons onboard.

Referring to FIGS. 3A-3B, in systems employing surface drives or ventilating propellers, the propellers 310, 311, 314 and 315 can be partially submerged for varying amounts of time, during which time the propellers can develop substantial lateral (athwartships) and vertical forces. In multiple-drive installations of this kind, the rotation of the at least two of the propellers typically opposes each other. When a tie bar is used in these installations, a substantial net force is exerted on the tie-bar due to the substantially equal and opposite lateral forces generated by the propellers. For example, as shown in FIG. 3A, tie bar 312 undergoes outward tension 313 when the propellers 310, 311 are outboard rotating; also as shown in FIG. 3B, tie bar 316 undergoes compression forces 317 if the propellers 314, 315 are inboard rotating. By virtue of the tie-bar connection, the lateral forces are substantially cancelled out and the steering drives are not subjected to any significant load associated with the lateral force component of the partially submerged propellers.

In view of the above discussion, and in view of other considerations relating to design and operation of marine vessels, it is desirable to have a marine vessel control system which can provide thrust forces in a plurality of directions, and which can control thrust forces in a safe and efficient manner.

BRIEF SUMMARY

One embodiment of the disclosure comprises an apparatus to be used with a marine vessel comprising a first steerable drive and a second steerable drive, the apparatus comprising a device, to be connected to the first steerable drive and to the second steerable drive, that provides for movement of the first and second steerable drives relative to each other and that also maintains a minimum distance between the first and second steerable drives so as to prevent the first and second steerable from contacting each other.

One embodiment of the apparatus comprises a telescoping concentric tube assembly having a mechanical stop. Another embodiment comprises a sliding bar arrangement having a mechanical stop. Another embodiment comprises a first guard to be connected to the first steerable drive and a second guard to be coupled to the second steerable drive. Still another embodiment comprises an adaptive tie bar arrangement having a configurable length that can be controlled to allow movement of the first steerable drive and the second steerable drive with respect to each other and that also can be controlled to provide a fixed distance between the first and second steerable drives. It is to be appreciated that any of the embodiments can be used either alone or in combination.

According to aspects of the disclosure, the adaptive tie bar arrangement can be any of a controllable mechanical locking device, a hydraulic locking device, and an electromechanical locking device. It is to be appreciated that any of these aspects can be used either alone or in combination with any of the embodiments disclosed herein.

According to one embodiment of the disclosure, the apparatus further comprises a processor configured to receive at least a first vessel control signal corresponding to any of a rotational movement command, a translational movement command, and a combination of a rotational movement and a translational movement command, and configured to generate at least a first steerable drive actuator control signal and a second steerable drive actuator control signal, and a first trim actuator control signal and a second trim actuator control signal. The processor is also configured to control the first steerable drive and the second steerable drive to provide a fixed distance between the first and second steerable drives when the first and second steerable drives are partially submerged, and so as to individually control the first steerable drive and the second steerable drives and allow the first steerable drive and the second steerable drive to move relative to each other when the first and second steerable drives are substantially submerged. It is to be appreciated the processor can be used with any of the embodiments and aspects disclosed herein.

According to another embodiment of the disclosure, the apparatus further comprises a processor configured to provide the first steerable drive actuator control signal, the second steerable drive actuator control signal, the first trim actuator control signal and the second trim actuator control signal so as to provide opposite forces with the first and second steerable drives by providing a forward thrust with the first steerable drive and a reverse thrust with the second steerable drive so as to create rotational forces on the marine vessel with substantially no translational forces on the marine vessel. It is to be appreciated the processor can be used with any of the embodiments and aspects disclosed herein.

According to another embodiment of the disclosure, the apparatus further comprises a processor configured to provide the first steerable drive actuator control signal, the second steerable drive actuator control signal, the first trim actuator control signal and the second trim actuator control signal so as to induce a net translational force to the marine vessel so that substantially no net rotational force is induced to the marine vessel, in response to the first vessel control signal that corresponds to only a translational thrust command and a zero rotational thrust command; and induce a net force to the marine vessel substantially in a direction of the first vessel control signal that corresponds to a combination of a translational thrust command and a rotational thrust command, for all combinations of the rotational and translational thrust commands. It is to be appreciated the processor can be used with any of the embodiments and aspects disclosed herein.

According to another embodiment of the disclosure, the apparatus further comprises a processor configured to provide the first steerable drive actuator control signal, the second steerable drive actuator control signal, the first trim actuator control signal and the second trim actuator control signal so as to induce a net translational force to the marine vessel so that substantially no net rotational force is induced to the marine vessel, in response to the first vessel control signal that corresponds to only a translational thrust command and a zero rotational thrust command; induce a net force to the marine vessel substantially in a direction of the first vessel control signal that corresponds to a combination of a translational thrust command and a rotational thrust command, for all combinations of the rotational and translational thrust commands; and further so as to control the first steerable drive and the second steerable drive to create a differential thrust between the first steerable drive and the second steerable drive to induce the net rotational force to the marine vessel. It is to be appreciated the processor can be used with any of the embodiments and aspects disclosed herein.

According to another embodiment of the disclosure, the apparatus further comprises a processor configured to provide the first steerable drive actuator control signal, the second steerable drive actuator control signal, the first trim actuator control signal and the second trim actuator control signal so as to induce a net transverse thrust to the marine vessel without substantially inducing any forward-reverse thrust or rotational thrust to the marine vessel in response to the first vessel control signal that corresponds to only a transverse thrust command; induce a net forward-reverse thrust to the marine vessel without substantially inducing any transverse thrust or rotational thrust to the marine vessel in response to the first vessel control signal that corresponds to only a forward-reverse thrust command; and induce a net rotational thrust to the marine vessel without substantially inducing any forward-reverse thrust or transverse thrust to the marine vessel, in response the first vessel control signal that corresponds to only a rotational thrust command. It is to be appreciated the processor can be used with any of the embodiments and aspects disclosed herein.

According to another embodiment of the disclosure, the apparatus further comprises a processor configured to provide the first steerable drive actuator control signal, the second steerable drive actuator control signal, the first trim actuator control signal and the second trim actuator control signal so as to induce a net translational force to the marine vessel so that substantially no net rotational force is induced to the marine vessel in response to the first vessel control signal resulting from movement of a first vessel control apparatus along two degrees of freedom and with a second vessel control apparatus in a neutral position; and to induce a net force to the marine vessel, in response to the first vessel control signal, substantially in a same direction as a combination of movement of the first vessel control apparatus and the second vessel control apparatus, for all movements of the first vessel control apparatus along the two degrees of freedom and for all movements of the second vessel control apparatus along the third degree of freedom. It is to be appreciated the processor can be used with any of the embodiments and aspects disclosed herein.

According to another embodiment of the disclosure, the apparatus further comprises a processor configured to provide the first steerable drive actuator control signal, the second steerable drive actuator control signal, the first trim actuator control signal and the second trim actuator control signal so as to create a differential thrust between the first steerable drive and the second steerable drive so as to induce the net rotational thrust to the marine vessel, without substantially inducing any forward-reverse thrust or transverse thrust to the marine vessel, in response the first vessel control signal that corresponds to only a rotational thrust command. It is to be appreciated the processor can be used with any of the embodiments and aspects disclosed herein.

According to another embodiment of the disclosure, the apparatus further comprises a processor configured to provide the first steerable drive actuator control signal, the second steerable drive actuator control signal, the first trim actuator control signal and the second trim actuator control signal so as to provide opposite forces with the first and second steerable drives by providing a forward thrust with the first steerable drive and a reverse thrust with the second steerable drive so as to create rotational forces on the marine vessel with substantially no translational forces on the marine vessel. It is to be appreciated the processor can be used with any of the embodiments and aspects disclosed herein.

According to another embodiment of the disclosure, the apparatus further comprises a processor configured to flip the first steerable drive actuator control signal, the second steerable drive actuator control signal, the first trim actuator control signal and the second trim actuator control signal in response to the first vessel control signal that corresponds to a full astern control command from the first vessel control signal that corresponds to a full ahead control command. It is to be appreciated the processor can be used with any of the embodiments and aspects disclosed herein.

According to another embodiment of the disclosure, the apparatus further comprises a processor configured to induce a net translational force to the marine vessel in response to the first vessel control signal comprising only the translational thrust command and a zero rotational thrust command, so that substantially no net rotational force is induced to the marine vessel; to induce a net force to the marine vessel, in response to the first vessel control signal comprising a combination of the translational thrust command and the rotational thrust command, substantially in a direction of a combination of the translational thrust command and the rotational thrust command for all combinations of the rotational and translational thrust commands; and to flip the first steerable drive actuator control signal, the second steerable drive actuator control signal, the first trim actuator control signal and the second trim actuator control signal in response to the first vessel control signal that corresponds to a full astern control command from the first vessel control signal that corresponds to a full ahead control command. It is to be appreciated the processor can be used with any of the embodiments and aspects disclosed herein.

According to one embodiment, a method for controlling a marine vessel having a first steerable drive and a second steerable comprises providing a device to be connected the first steerable drive and to the second steerable drive that provides for movement of the first and second steerable drives relative to each other and that also maintains a minimum distance between the first and second steerable drives so as to prevent the first and second steerable from contacting each other.

One embodiment of the method comprises providing a telescoping concentric tube assembly having a mechanical stop. Another embodiment comprises providing a sliding bar arrangement having a mechanical stop. Another embodiment comprises providing a first guard to be connected to the first steerable drive and a second guard to be connected to the second steerable drive. Still another embodiment comprises providing an adaptive tie bar arrangement having a configurable length that can be controlled to allow movement of the first steerable drive and the second steerable drive with respect to each other and that also can be controlled to provide a fixed distance between the first and second steerable drives. It is to be appreciated that any of the embodiments can be used either alone or in combination.

Aspects of the disclosure include providing the adaptive tie bar arrangement as any of a controllable mechanical locking device, a hydraulic locking device, and an electromechanical locking device. It is to be appreciated that any of these aspects can be used either alone or in combination with any of the embodiments disclosed herein.

One embodiment of the disclosure further comprises controlling the first steerable drive and the second steerable drive to provide a fixed distance between the first and second steerable drives when the first and second steerable drives are partially submerged, and so as to individually control the first steerable drive and the second steerable drives and allow the first steerable drive and the second steerable drive to move relative to each other when the first and second steerable drives are substantially submerged. It is to be appreciated that this can be done with any of the embodiments and aspects disclosed herein.

Another embodiment of the disclosure further comprises providing opposite forces with the first and second steerable drives by providing a forward thrust with the first steerable drive and a reverse thrust with the second steerable drive so as to create rotational forces on the marine vessel with substantially no translational forces on the marine vessel. It is to be appreciated that this can be done with any of the embodiments and aspects disclosed herein.

Another embodiment of the disclosure further comprises inducing a net translational force to the marine vessel so that substantially no net rotational force is induced to the marine vessel, in response to the first vessel control signal that corresponds to only a translational thrust command and a zero rotational thrust command; and inducing a net force to the marine vessel substantially in a direction of the first vessel control signal that corresponds to a combination of a translational thrust command and a rotational thrust command, for all combinations of the rotational and translational thrust commands. It is to be appreciated that this can be done with any of the embodiments and aspects disclosed herein.

Another embodiment of the disclosure further comprises inducing a net translational force to the marine vessel so that substantially no net rotational force is induced to the marine vessel, in response to the first vessel control signal that corresponds to only a translational thrust command and a zero rotational thrust command; inducing a net force to the marine vessel substantially in a direction of the first vessel control signal that corresponds to a combination of a translational thrust command and a rotational thrust command, for all combinations of the rotational and translational thrust commands; and controlling the first steerable drive and the second steerable drive to create a differential thrust between the first steerable drive and the second steerable drive to induce the net rotational force to the marine vessel. It is to be appreciated that this can be done with any of the embodiments and aspects disclosed herein.

Another embodiment of the disclosure further comprises inducing a net transverse thrust to the marine vessel without substantially inducing any forward-reverse thrust or rotational thrust to the marine vessel in response to the first vessel control signal that corresponds to only a transverse thrust command; inducing a net forward-reverse thrust to the marine vessel without substantially inducing any transverse thrust or rotational thrust to the marine vessel in response to the first vessel control signal that corresponds to only a forward-reverse thrust command; and inducing a net rotational thrust to the marine vessel without substantially inducing any forward-reverse thrust or transverse thrust to the marine vessel, in response the first vessel control signal that corresponds to only a rotational thrust command. It is to be appreciated that this can be done with any of the embodiments and aspects disclosed herein.

Another embodiment of the disclosure further comprises inducing a net translational force to the marine vessel so that substantially no net rotational force is induced to the marine vessel in response to the first vessel control signal resulting from movement of a first vessel control apparatus along two degrees of freedom and with a second vessel control apparatus in a neutral position; and inducing a net force to the marine vessel, in response to the first vessel control signal, substantially in a same direction as a combination of movement of the first vessel control apparatus and the second vessel control apparatus, for all movements of the first vessel control apparatus along the two degrees of freedom and for all movements of the second vessel control apparatus along the third degree of freedom. It is to be appreciated that this can be done with any of the embodiments and aspects disclosed herein.

Another embodiment of the disclosure further comprises creating a differential thrust between the first steerable drive and the second steerable drive so as to induce the net rotational thrust to the marine vessel, without substantially inducing any forward-reverse thrust or transverse thrust to the marine vessel, in response the first vessel control signal that corresponds to only a rotational thrust command. It is to be appreciated that this can be done with any of the embodiments and aspects disclosed herein.

Another embodiment of the disclosure further comprises providing opposite forces with the first and second steerable drives by providing a forward thrust with the first steerable drive and a reverse thrust with the second steerable drive so as to create rotational forces on the marine vessel with substantially no translational forces on the marine vessel. It is to be appreciated that this can be done with any of the embodiments and aspects disclosed herein.

DETAILED DESCRIPTION

Figure 1A:
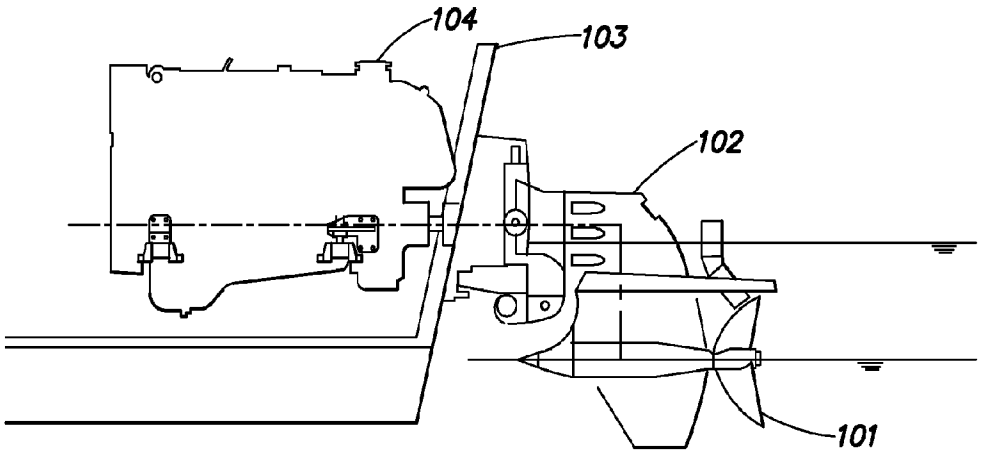
FIG. 1A illustrates a top view of an outboard drive that can be used in combination with embodiments disclosed herein.
Figure 1C:
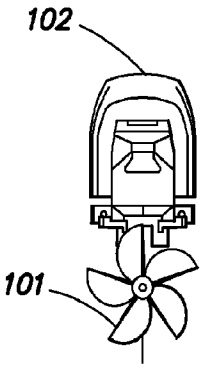
FIG. 1C illustrates a rear view of the outboard drive of FIG. 1A.
Figure 1B:
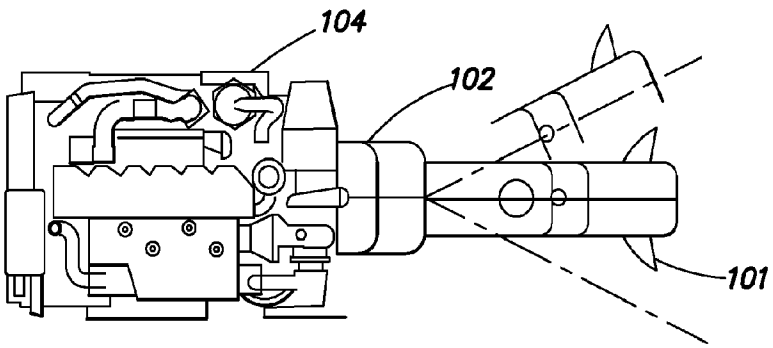
FIG. 1B illustrates a side view of the outboard drive of FIG. 1A.
Figure 1D:
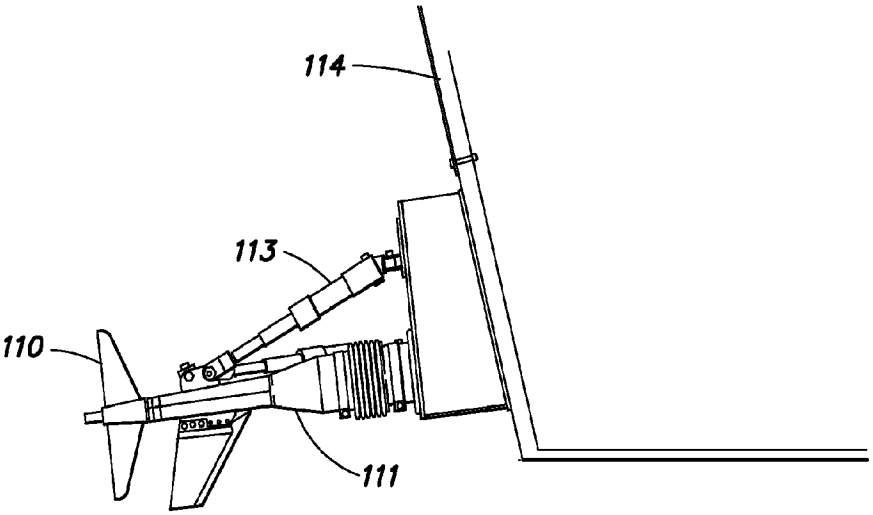
FIG. 1D illustrates a side view of the surface drive that can be used in combination with embodiments disclosed herein.
Figure 1E:
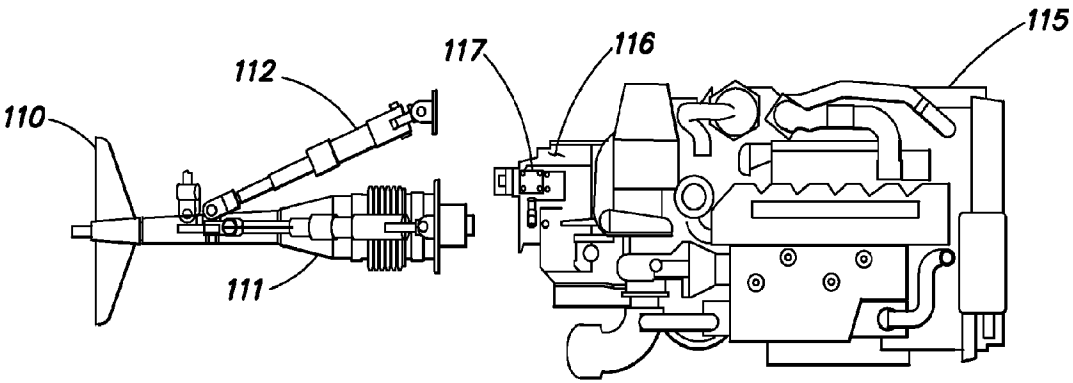
FIG. 1E illustrates a top view of an surface drive of FIG. 1D.
Figure 2A:
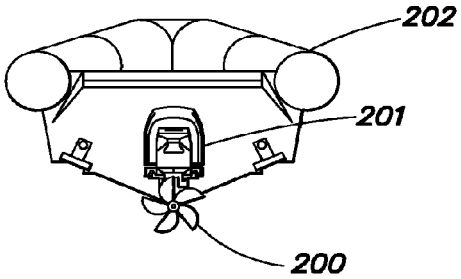
FIGS. 2A-2B illustrate rear view and top view of a marine vessel having a single outdrive.
Figure 2C:
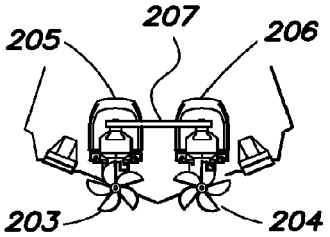
FIGS. 2C-2D illustrate rear view and top view of a marine vessel having dual outdrives and a tie-bar.
Figure 2B:
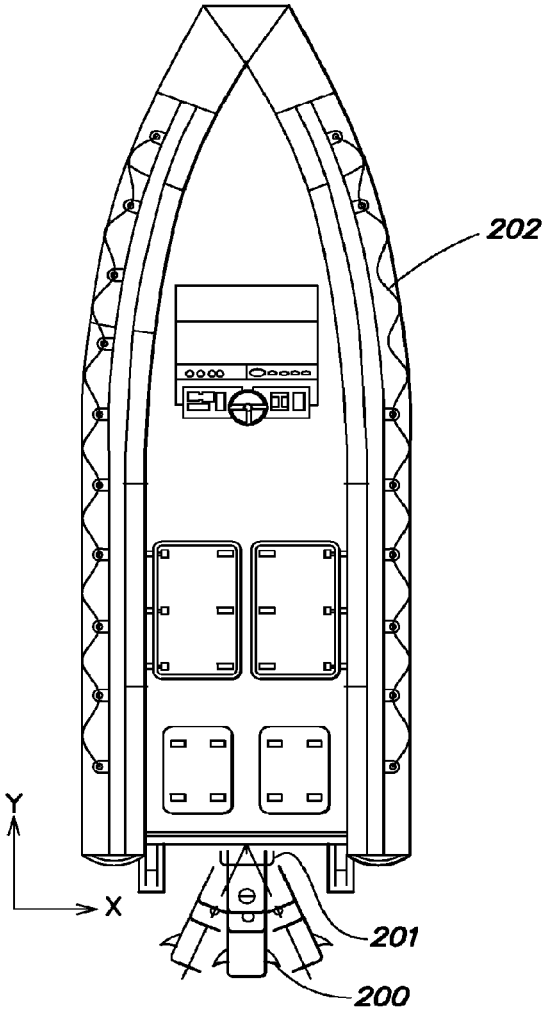
Figure 2D:
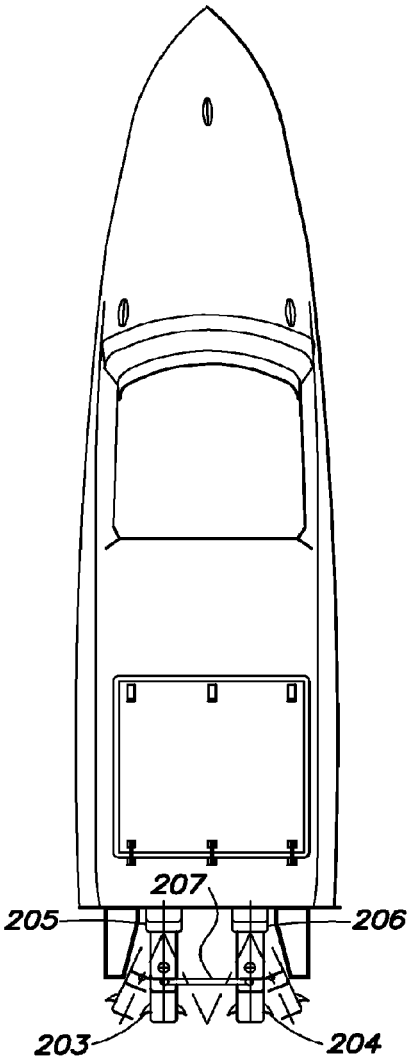
Figure 3A:
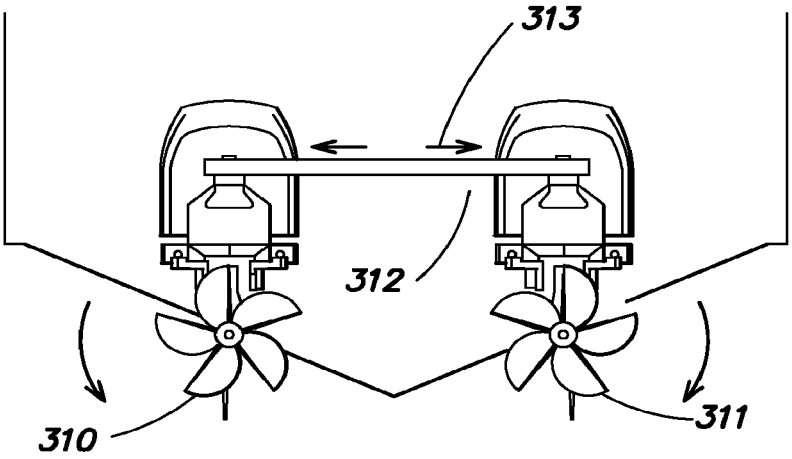
FIGS. 3A-3B illustrate forces generated on the tie bar by the dual outdrives of FIGS. 2A-2B.
Figure 3B:
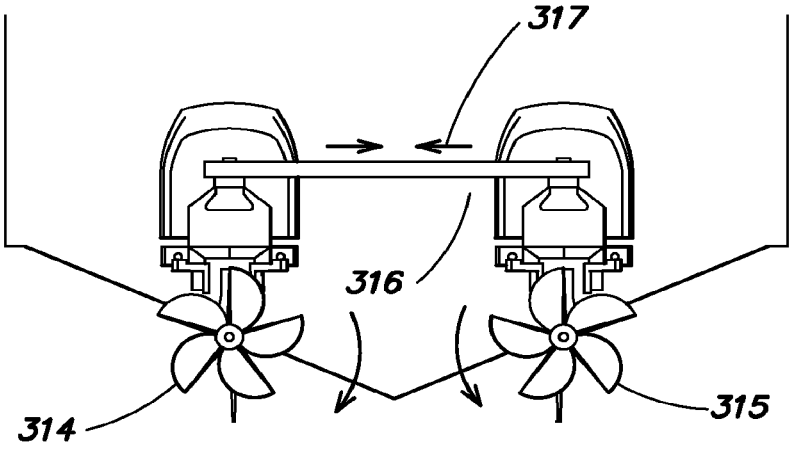

Prior to a detailed discussion of various embodiments of the present disclosure, it is useful to define certain terms that describe the geometry of a marine vessel and associated propulsion and control systems. A marine vessel has a forward end called a bow and an aft end called a stem. A line connecting the bow and the stern defines an axis hereinafter referred to the marine vessel's major axis. A vector along the major axis pointing along a direction from stem to bow is said to be pointing in the ahead or forward direction. A vector along the major axis pointing in the opposite direction (180° away) from the ahead direction is said to be pointing in the astern or reverse or backing direction.

Any axis perpendicular to the major axis is referred to herein as a "minor axis." A vessel has a plurality of minor axes, lying in a plane perpendicular to the major axis. Some marine vessels have propulsion systems which primarily provide thrust only along the vessel's major axis, in the forward or backward directions. Other thrust directions, along the minor axes, are generated with awkward or inefficient auxiliary control surfaces, rudders, planes, deflectors, etc.

The axis perpendicular to the marine vessel's major axis and nominally perpendicular to the surface of the water on which the marine vessel rests, is referred to herein as the vertical axis. The vector along the vertical axis pointing away from the water and towards the sky defines an up direction, while the oppositely-directed vector along the vertical axis pointing from the sky towards the water defines the down direction. It is to be appreciated that the axes and directions, e.g. the vertical axis and the up and down directions, described herein are referenced to the marine vessel. In operation, the vessel experiences motion relative to the water in which it travels. However, the present axes and directions are not intended to be referenced to Earth or the water surface.

The axis perpendicular to both the marine vessel's major axis and a vertical axis is referred to as an athwartships axis. The direction pointing to the left of the marine vessel with respect to the ahead direction is referred to as the port direction, while the opposite direction, pointing to the right of the vessel with respect to the forward direction is referred to as the starboard direction. The athwartships axis is also sometimes referred to as defining a transverse or "side-to-side" force, motion, or displacement. Note that the athwartships axis and the vertical axis are not unique, and that many axes parallel to said athwartships axis and vertical axis can be defined.

The marine vessel may be moved forward or backwards along the major axes. This motion is usually a primary translational motion achieved by use of the vessels propulsion systems when traversing the water as described earlier. Other motions are possible, either by use of vessel control systems or due to external forces such as wind and water currents. Rotational motion of the marine vessel about the athwartships axis which alternately raises and lowers the bow and stern is referred to as pitch of the vessel. Rotation of the marine vessel about its major axis, alternately raising and lowering the port and starboard sides of the vessel is referred to as roll. Finally, rotation of the marine vessel about the vertical axis is referred to as yaw. An overall vertical displacement of the entire vessel 10 that moves the vessel up and down (e.g. due to waves) is called heave.

In view of the above discussion, and in view of other considerations relating to design and operation of marine vessels, it is desirable to have a marine vessel control system which can provide forces in a plurality of directions, and which can control thrust forces in a safe and efficient manner. The present disclosure relates to marine vessel propulsion and control systems and more particularly to methods and devices for controlling and allowing marine vessel steering drives to move freely with respect to each other but to also prevent such steering drives from contacting each other. The disclosure also relates to a control system and method configured to receive at least a first vessel control signal corresponding to any of a rotational movement command, a translational movement command, and a combination of a rotational movement and a translational movement commands, and configured to generate at least a first steerable drive actuator control signal and a second steerable drive actuator control signal to control the first steerable drive and the second steerable drive to provide the fixed distance between the first and second steerable drives and so as to individually control the first steerable drive and the second steerable drives and allow the so the first steerable drive and the second steerable drive to move relative to each other. The disclosure also relates to the control system and method also configured to induce a net force to the marine vessel substantially in a direction of the first vessel control signal that corresponds to a combination of a translational thrust command and a rotational thrust command, for all combinations of the rotational and translational thrust commands.

The disclosure is illustrated in connection with propulsion systems comprising first and second steerable drives, particularly first and second outboard drives. However it is to be understood that some or all aspects of the present disclosure apply to systems using equivalent or similar components and arrangements, such as waterjet propulsion systems and systems using various prime movers not specifically disclosed herein.

Figure 4A:
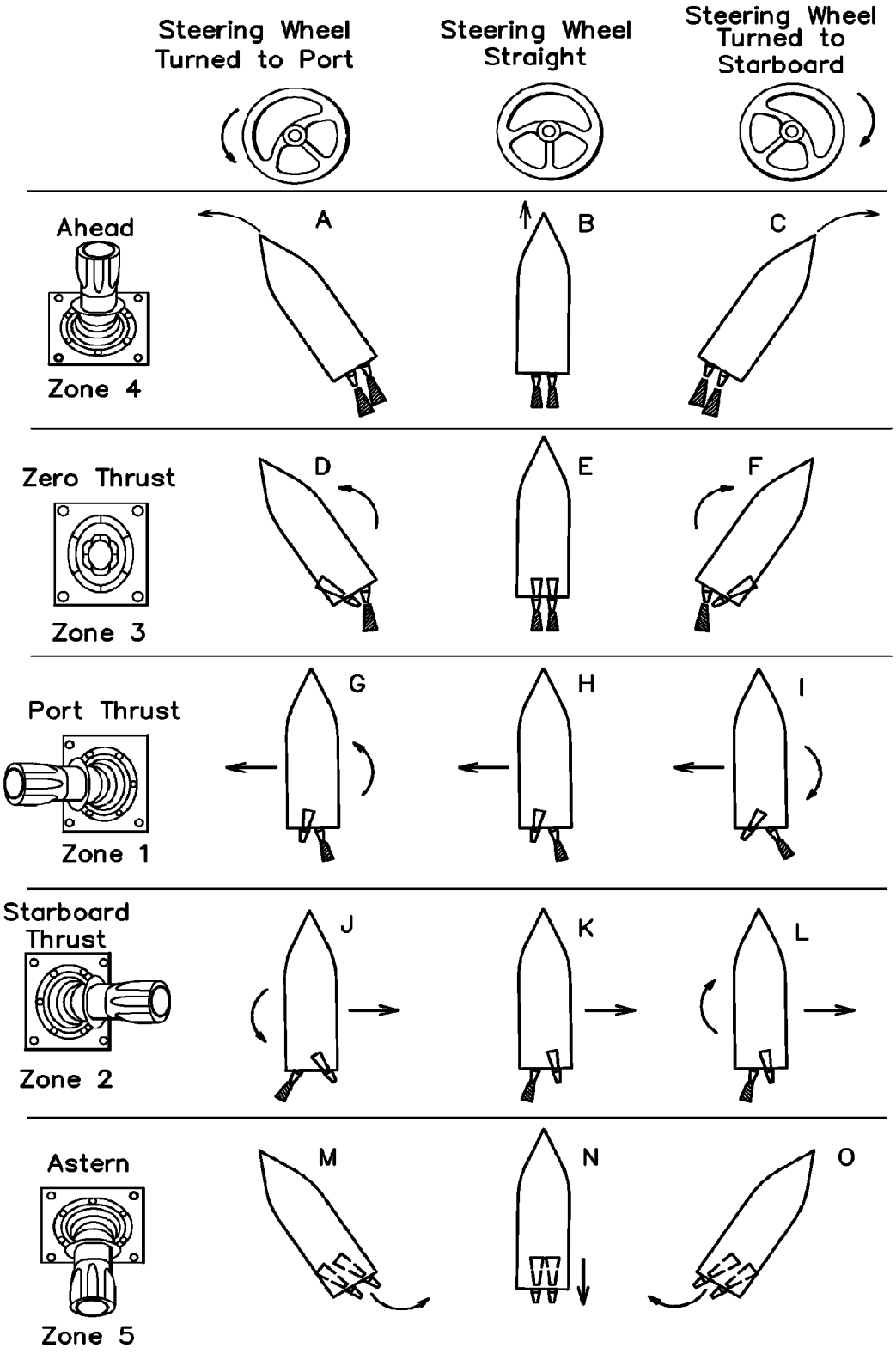
FIGS. 4A-4B are exemplary maneuvering diagrams illustrating movements that can be accomplished with a marine vessel configured with applicant's own joystick controller system and dual waterjets.
Figure 4B:
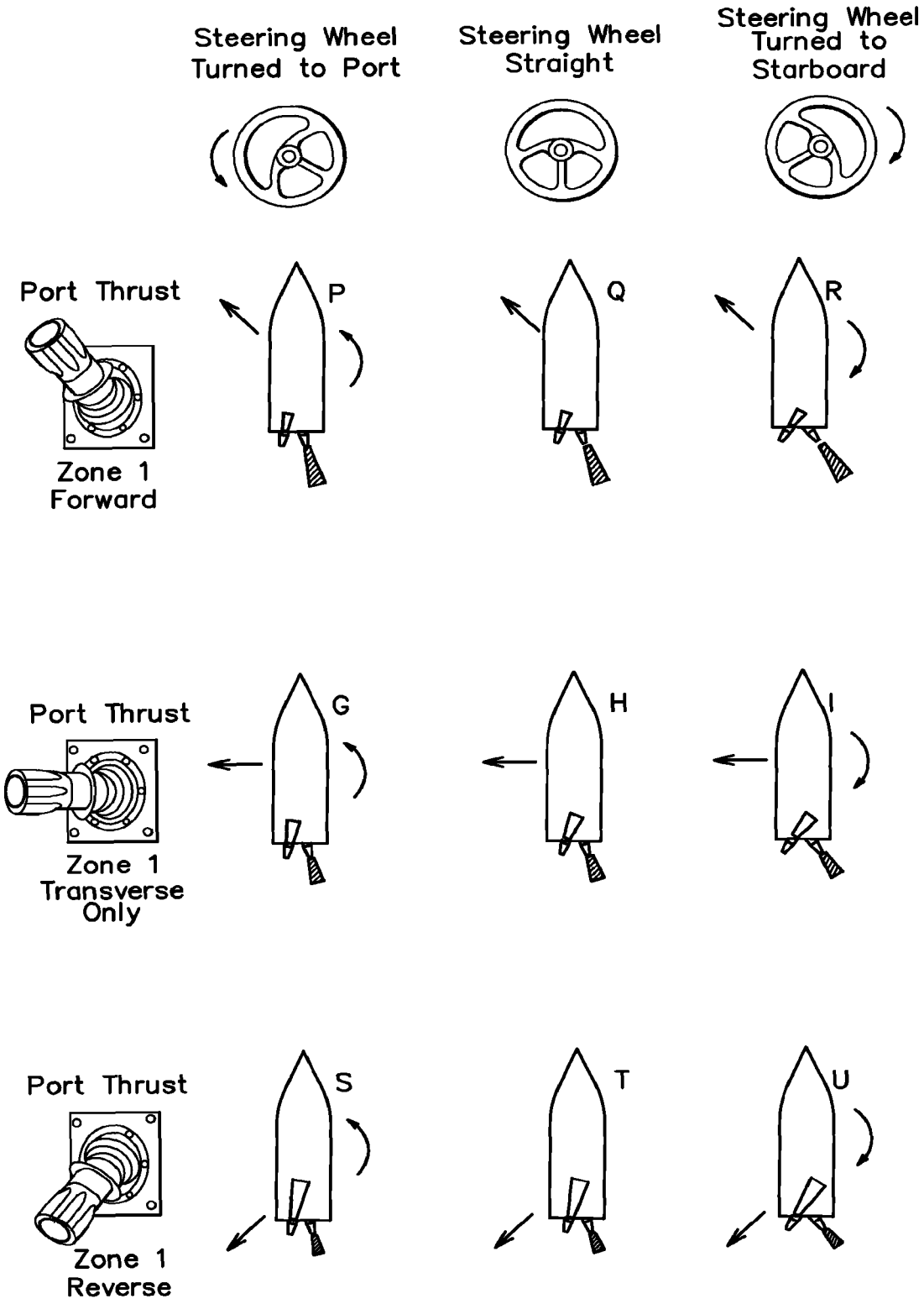

Referring to FIGS. 4A and 4B, there is illustrated an exemplary maneuvering diagram as described in U.S. Pat. No. 7,601,040 B2 corresponding to a joystick control system disclosed in the U.S. Pat. No. 7,601,040 B2 patent, that can be deployed on a waterjet-propelled craft. A primary challenge in achieving similar capability in marine craft equipped with steerable propellers and various other types of drives is that the drives are decoupled, which present a high risk that the propellers will contact each other and cause damage when controlling the steerable drives individually.

Thus, there is a need for a system to enhance the performance of marine craft fitted with multiple steerable propellers to eliminate the risk of contact of the propellers and that also provides for individual control of the steerable drives. It is appreciated that the high-speed and low-speed performance of a marine craft (planing type or otherwise) fitted with multiple steerable drives can be improved by decoupling the steering control of each drive such that the steering function of each drive is independently controlled with a separate actuator. The various embodiments of the system(s) disclosed herein facilitate individual control of each steerable drive, thereby rendering a propulsion system with greater degrees of freedom and which can take full advantage of a joystick maneuvering system or other means of control, whereby variable force vectors can be developed. Such individual control and force vectoring capability, not otherwise achievable when steerable drives are mechanically linked such that the drives remain substantially parallel to each other irrespective of the steering angle, enhances maneuvering performance. The various embodiments of a system disclosed herein allow the drives to move freely while preventing the drives from contacting each other.

If the two or more drives are decoupled such that the steering angle of each drive can be controlled independently, many of the control algorithms and resulting features and advantages of the systems and methods disclosed in U.S. Pat. Nos. 7,052,338; 7,037,150; 7,216,599; 7,222,577; 7,500,890'; 7,641,525; 7,601,040; 7,972,187; and published U.S. patent application Ser. Nos. 11/960,676; 12/753,089, which are herein incorporated by reference in their entirety, can be achieved. In particular, FIGS. 42 and 43 of patent U.S. Pat. No. 7,601,040 B2 shows a series of maneuvers that can be achieved by individually controlling integral nozzle/reversing bucket devices. As described in column 42 and shown in FIGS. 44-48 (example steerable propeller control algorithm) of the same application, similar thrust vectoring results can be achieved by using steerable propellers instead of waterjets.

Figure 5A:
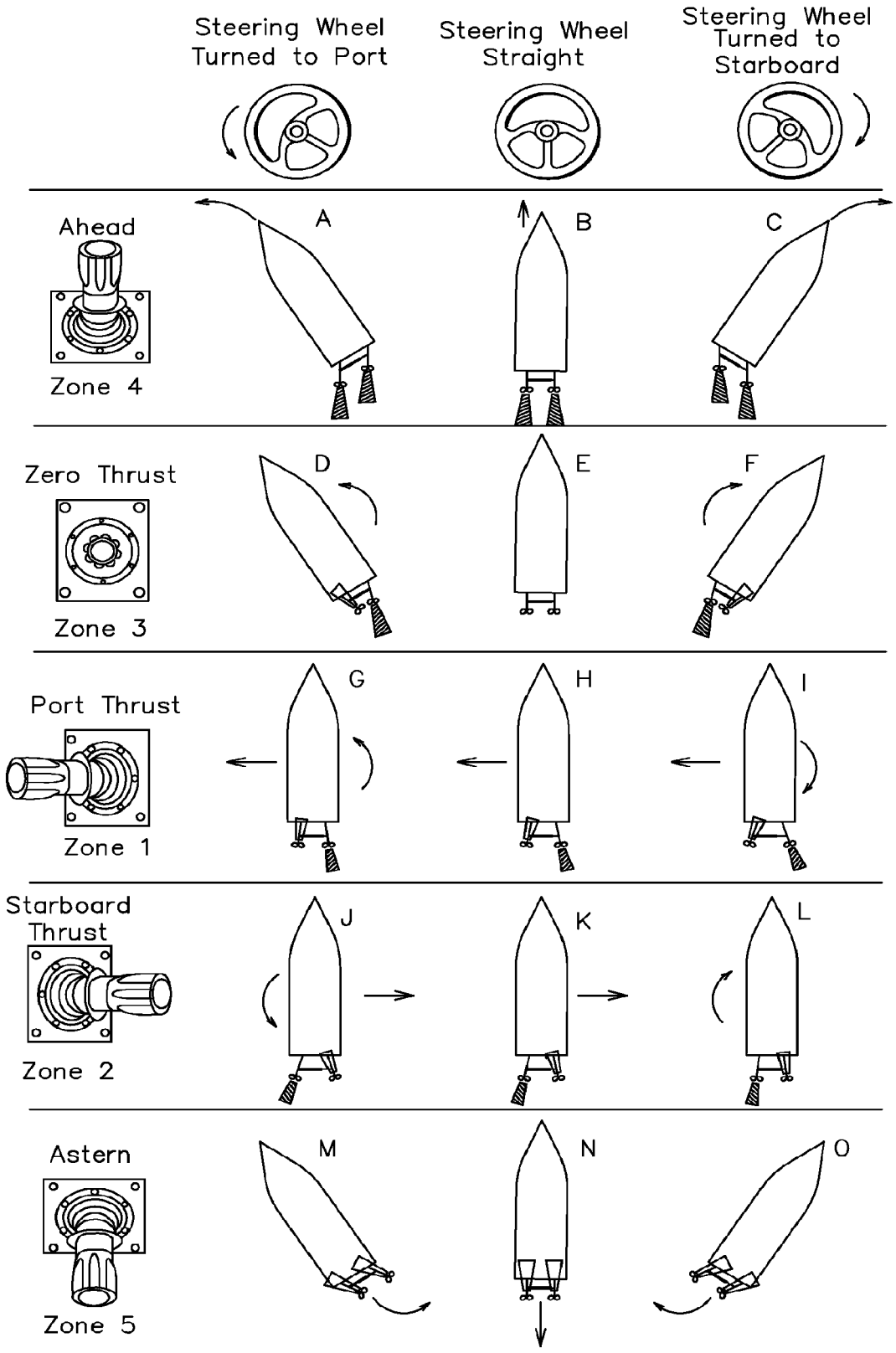
FIGS. 5A-5B are exemplary maneuvering diagrams illustrating movements that can be accomplished with a marine vessel configured with embodiments of this disclosure and dual outboard drives.
Figure 5B:
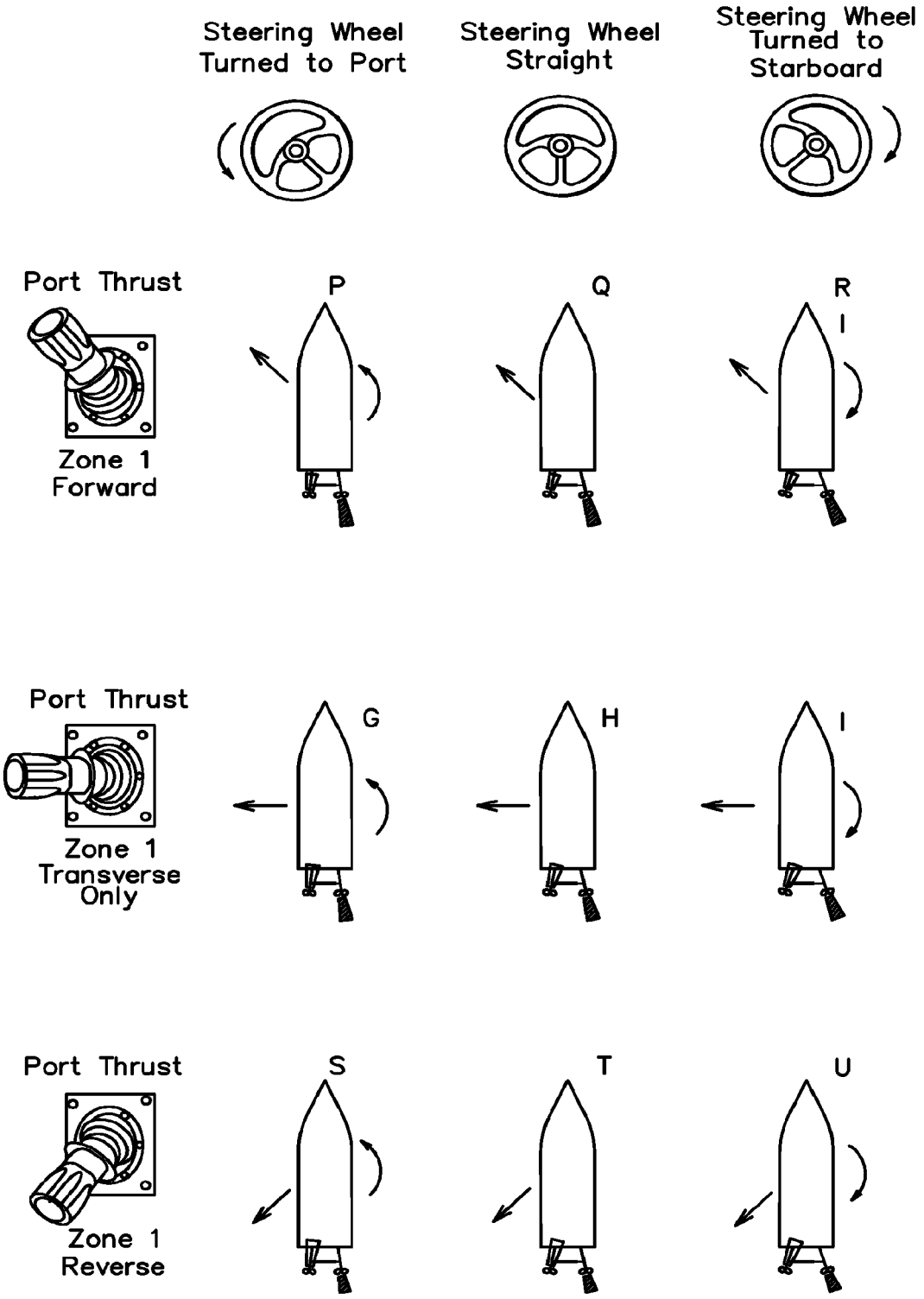

As an example, replacing the conventional tie bar with one of the embodiments disclosed herein enables a joystick system or other electronic control system to maneuver a dual steerable propeller driven craft in accordance with the maneuvering diagram depicted in FIGS. 5A and 5B, which illustrate the movements of the craft corresponding to various positions of the joystick and tiller (or steering wheel). The maneuvering diagram depicted in FIGS. 5A and 5B reflects the capabilities of a joystick control system with underlying control algorithms incorporating a trolling gear summarized in FIGS. 12-17. To aid in disclosing the control algorithms with trolling gear functionality included, FIG. 12 defines five control zones (1-5) in terms of joystick position, and FIGS. 13-17 present the steerable propeller control algorithm signal diagram for Zones 1-5, respectively.

One problem with decoupling the steering control of drives located in close proximity to each other is the potential for the drives to collide and interfere with one another. While the electronic control system can, in principle, be configured to prevent a collision under normal operating conditions, the risk that the drives will collide becomes unacceptable in the event that the control system malfunctions or one or both of the drives is manually overridden. For this reason, a tie-bar is typically installed.

Figure 6A:
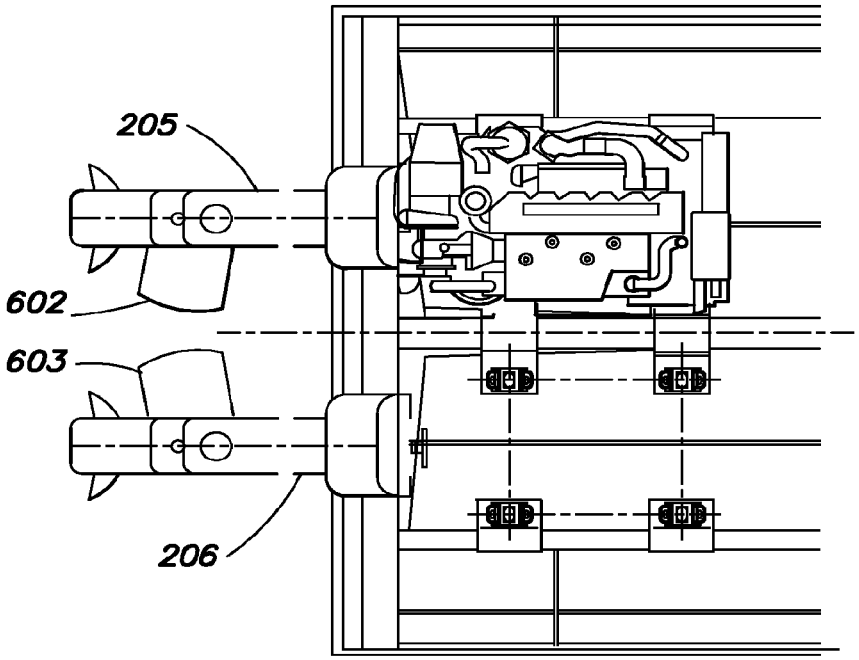
FIGS. 6A-6B illustrate an embodiment of guards according to this disclosure that can be used with a marine vessel configured with dual outboard drives.
Figure 6B:
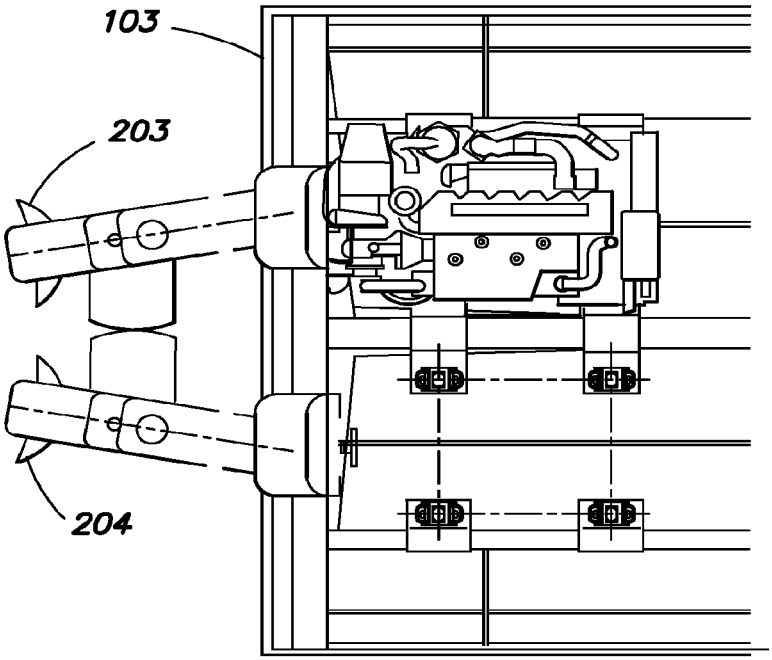

A solution to the problem of preventing colliding of adjacent drives while providing freedom to independently steer the drives is to install a device that allows the drives to move freely while preventing the clearance between the drives from dropping below a certain minimum value. One embodiment comprises a mechanical guard or bumper installed on one or multiple drives such that the guard(s) make contact when a certain minimum clearance is attained, thereby preventing any sensitive components, such as the propeller, from making contact. The guards would be designed to take the full force of the actuating system without harming any part of the drive. An example of this type of arrangement is illustrated in FIG. 6A (drives parallel) and FIG. 6B (drives positioned inward), in which port bumper guard 602 and starboard bumper guard 603 is mounted to port drive 205 and starboard drive 206, respectively. It is to be appreciated that various alterations, modifications, and improvements of the example shown in FIGS. 6A-B will occur to those skilled in the art. Such alterations, modifications, and improvements are intended to be part of this disclosure and are intended to be within the scope of the system disclosed herein.

Figure 7A:
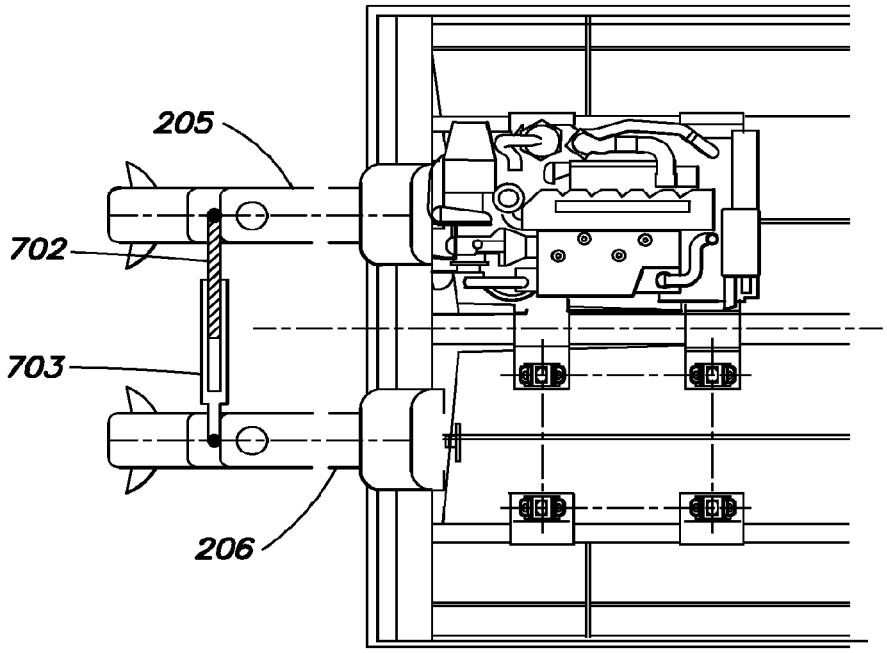
FIGS. 7A-7B illustrate an embodiment of a sliding bar according to this disclosure that can be used with a marine vessel configured with dual outboard drives.
Figure 7B:
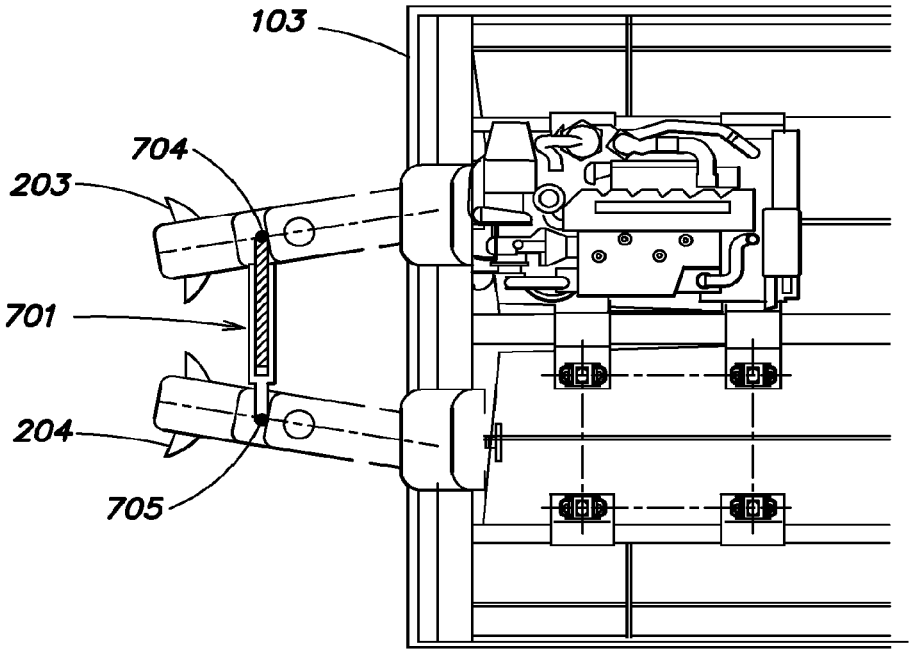

Another embodiment comprises a sliding apparatus located in between and attached to adjacent drives and incorporating a mechanical stop to prevent the clearance between the drives from dropping below a certain value. The device may consist of two or more members (which may or may not be connected) that are allowed to move or rotate with respect to each other, and which incorporates one or more mechanical stops to prevent the clearance between propellers and other critical components from dropping below a certain value. One embodiment consists of telescoping concentric tubes installed between adjacent drives, which are attached to each end of the sliding apparatus by means of a connection such as a pin or ball joint. A mechanical stop built into the sliding apparatus prevents the clearance between adjacent drives from dropping below a certain value. Another embodiment comprises a sliding bar arrangement consisting of an assembly of two or more parallel bars that are permitted to slide relative to one another. A schematic example of this type of system can be seen in FIG. 7A (drives parallel) and FIG. 7B (drives positioned inward), in which sliding bar assembly 701 comprises rod 702 and tube 703, port attachment (joint) 704 and starboard attachment (joint) 705. Yet another embodiment consists of two members flexibly joined together to allow rotation with respect to each other, with the free end of each member flexibly joined to a drive, wherein relative rotation of the two members results in varying distances between the two free ends; a means to limit the relative rotation, such as a mechanical stop, would be provided to prevent the clearance between drives from dropping below a certain value. Variations of these implementations include but are not limited to those incorporating alternate means of attachment, for example, a compound clevis (allowing two rotational degrees freedom) or a ball joint (allowing three rotational degrees of freedom). Other variations of these implementations include but are not limited to those incorporating alternate means of achieving variable distance between the drives, for example, a hydraulic cylinder deployed in any number of ways to facilitate the functionality described above. It is to be appreciated that various alterations, modifications, and improvements of the example shown in FIGS. 7A-B and embodiments described herein will occur to those skilled in the art. Such alterations, modifications, and improvements are intended to be part of this disclosure and are intended to be within the scope of the system disclosed herein.

In the typical surface-drive or ventilating propeller application, the propellers can be partially submerged for varying amounts of time, during which time the propellers develop substantial lateral (athwartships) and vertical forces. In most of these kinds of multiple-drive installations, the rotation of at least two of the propellers opposes each other. When a tie bar is used in these installations, a substantial net force is exerted on the tie-bar (tension if outboard rotation, compression if inboard rotation) due to the substantially equal and opposite lateral forces generated by the propellers. By virtue of the tie-bar connection, the lateral force transferred to the hull by an individual drive is minimized, and the steering cylinder(s) is not subjected to significant load associated with the lateral force component of the partially submerged propellers.

On account of the lateral forces induced by the surface propeller (discussed above), removing the tie-bar that would otherwise nullify the lateral forces will necessitate the individual steering cylinders to counter the forces of each individual drive. In such an arrangement, the mechanical loading of the steering cylinders will likely be increased substantially, and in many cases, the standard mechanical and hydraulic components that are normally equipped with the drive will be inadequately sized to counter the load in a steady and/or dynamic condition. In these cases it would be useful to have a variable-length or variable-geometry tie-bar that is locked in conditions when the lateral force on an individual propeller is substantial and unlocked (such that the drives could be controlled individually) when it is desirable to move the drives relative to each other. Such an "adaptive" tie-bar could have a locking means that is mechanical (controlled via a linkage), hydraulic (controlled using a mechanical or electric valve), or electric (clutch, motor, etc.), or a combination of these methods. The adaptive (or variable-geometry lockable) tie-bar described above may or may not incorporate a mechanical stop for the purpose of limiting the clearance between adjacent drives.

Figure 9:
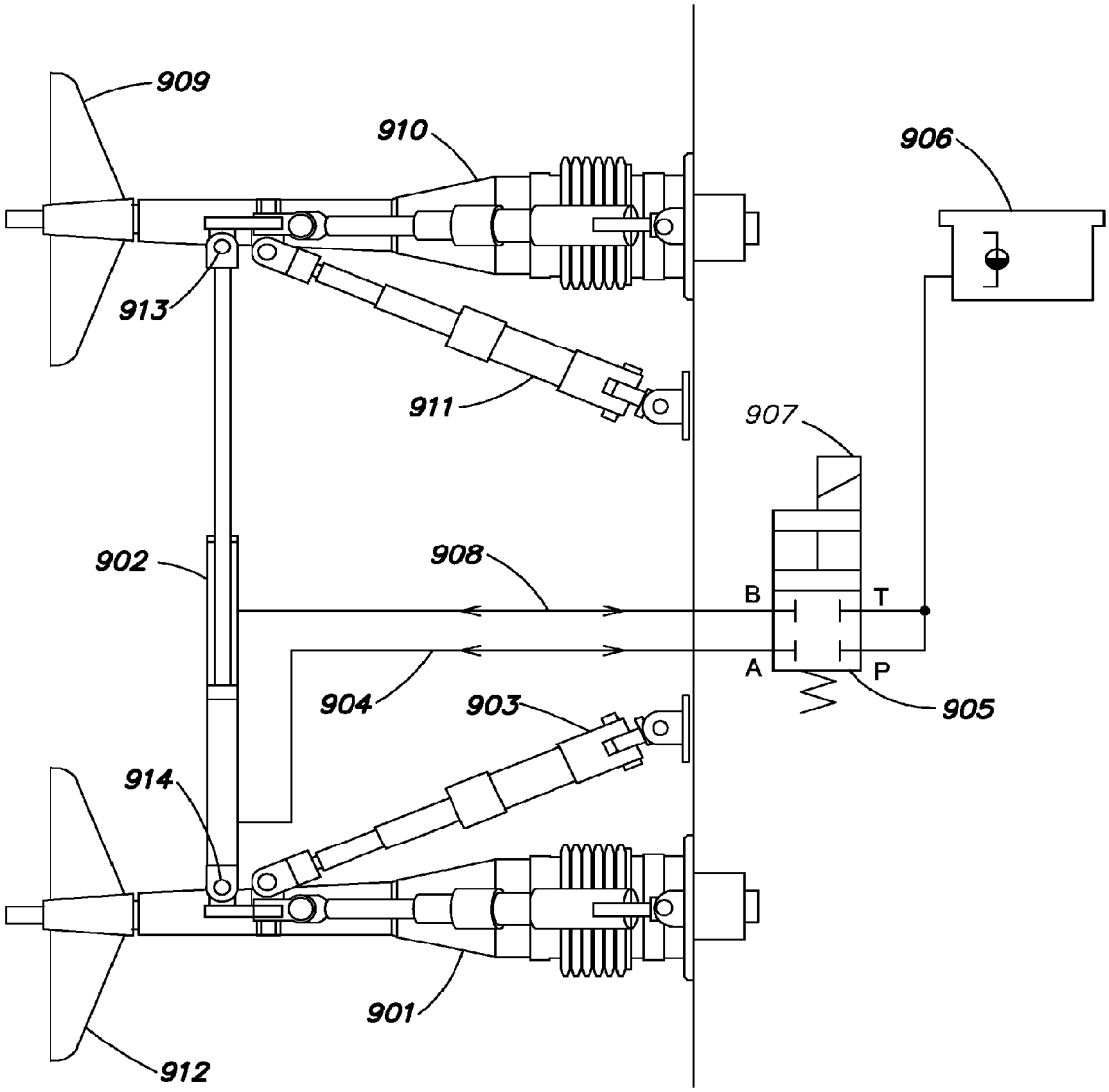
FIG. 9 illustrates an embodiment of a hydraulic locking system variable length tie-bar according to this disclosure that can be used with a marine vessel configured with dual outboard drives.

One example of a locking tie-bar implementation is the system shown in FIG. 9, where the conventional tie-bar is replaced with a hydraulic cylinder 902 operating in a passive mode, i.e., no hydraulic pump is utilized. The ends of hydraulic cylinder 902 are fitted with port attachment (joint) 913 and starboard attachment (joint) 914. When the hydraulic fluid is confined to the cylinder 902 by means of control valve 905 (shown in FIG. 9) in the locked position, the hydraulic lock causes cylinder 902 to behave in the manner of a conventional tie-bar, whereby drives 901 and 910 are maintained in a fixed relationship relative to each other. When one or both drives are to be moved relative to the other, for example, when performing maneuvers such as illustrated in FIG. 5A, the hydraulic fluid is permitted to move from one side of the piston in cylinder 902 to the other side by actuating control valve 905 such that fluid is allowed to move freely between Ports P and A and Ports T and B, with any excess (make-up) fluid channeled to (from) reservoir 906, depending on the direction of stroke. Depending on the implementation of the control system, control valve 905 may be configured so that it is in the closed or open position when actuated. It is to be appreciated that various alterations, modifications, and improvements of the example shown in FIG. 9 will occur to those skilled in the art. Such alterations, modifications, and improvements are intended to be part of this disclosure and are intended to be within the scope of the system disclosed herein.

As discussed above, the forces that may be encountered when the propeller is partially submerged can be quite substantial, potentially causing some difficulty creating the forces to move the drives when the tie-bar is unlocked. In these cases it may be advantageous to deploy a device or some means to create tension and/or compression forces within or in place of the tie-bar apparatus. Such a device could reduce the forces that are imposed on the individual steering cylinders, due to the fact that the applied force vector is substantially orthogonal to the drive axis. Any of the "adaptive" tie-bar designs discussed above (mechanical, hydraulic, electric, etc.) can be combined with a means to develop tension and or compression forces to create an "active" tie-bar device. The active (or actuating) tie-bar described above may or may not incorporate a mechanical stop for the purpose of limiting the clearance between adjacent drives.

Figure 8C:
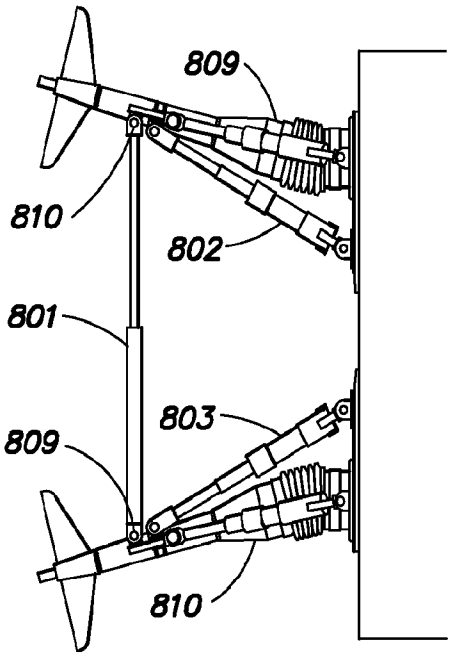
FIGS. 8A-8C illustrate an embodiment of a variable length tie-bar according to this disclosure that can be used with a marine vessel configured with dual outboard drives.
Figure 8B:
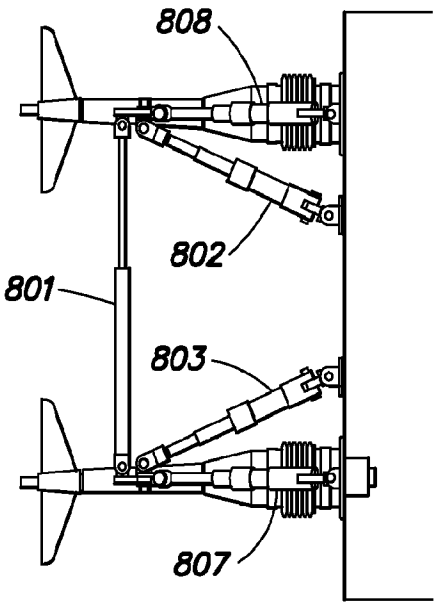
Figure 8A:
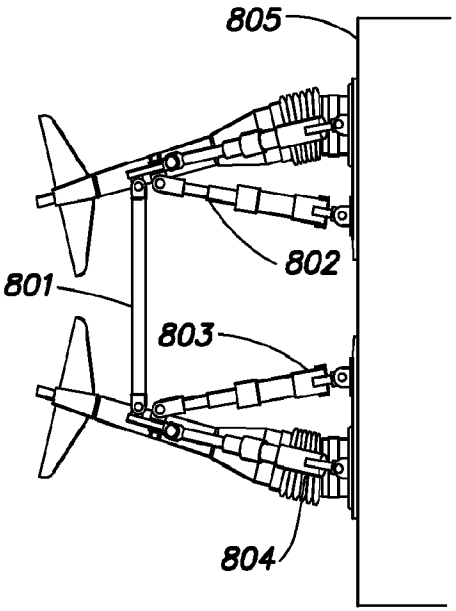

One example of an active tie-bar implementation utilizes similar outboard components (i.e., those external to the hull) as used in the example locking tie-bar implementation (shown in FIG. 9 and also as shown in FIGS. 8A, 8B and 8C). However, the hydraulic system for the active tie-bar system will differ from that of the locking tie-bar system in that the hydraulic system for the active tie-bar system enables the active extension and retraction of tie-bar actuator 1001.

Figure 10:
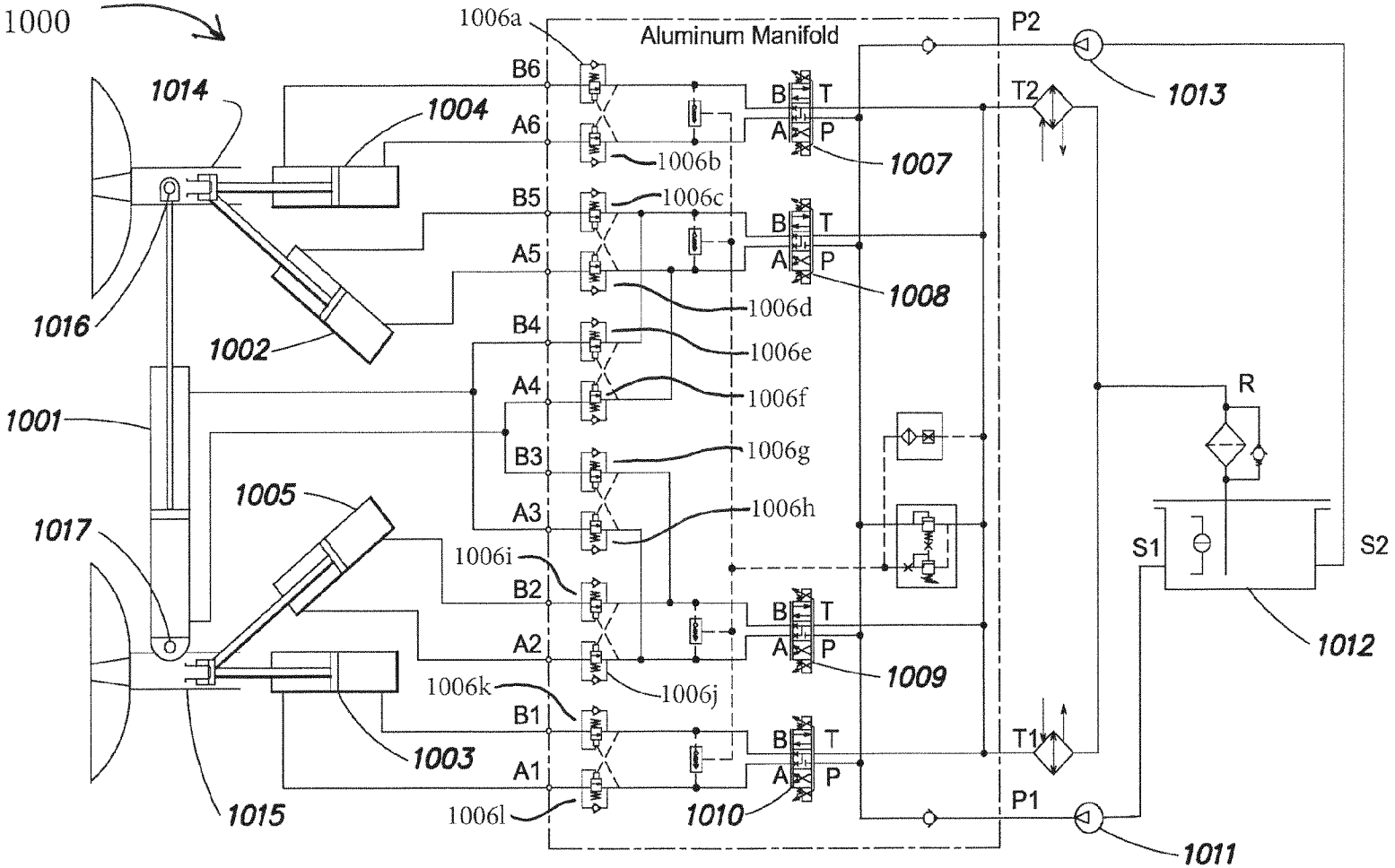
FIG. 10 illustrates an embodiment of a hydraulic system that can be used with the hydraulic variable length tie-bar of FIG. 9.

FIG. 10 shows hydraulic circuit 1000. The hydraulic circuit 1000 includes tie-bar actuator 1001 configured to be coupled to port drive 1014 ("first drive") and starboard drive 1015 ("second drive"). The ends of tie-bar actuator 1001 are fitted with port attachment joint) 1016 and starboard attachment (joint) 1017. The hydraulic circuit 1000 fluidically actuates the tie-bar actuator 1001 by generating tension and/or compression forces within the tie-bar actuator 1001. The tie-bar actuator 1001 actively extends or retracts in response to being fluidically actuated by the hydraulic circuit 1000.

The hydraulic circuit 1000 includes port steering actuator 1002 ("first steering actuator") coupled to and configured to actuate the port drive 1014 and starboard steering actuator 1005 ("second steering actuator") coupled to and configured to actuate the starboard drive 1015. The hydraulic circuit 1000 includes port trim actuator 1004 coupled to port drive 1014 and starboard trim actuator 1003 coupled to starboard drive 1015. The hydraulic circuit includes counterbalance valves 1006*a*, 1006*b*, 1006*c*, 1006*d*, 1006*e*, 1006*f*, 1006*g*, 1006*h*, 1006*i*, 1006*j*, 1006*k*, and 10061. The hydraulic circuit 1000 includes port trim valve 1007, port steering valve 1008 ("valve"), starboard steering valve 1009 ("second valve"), starboard trim valve 1010, pump 1011, reservoir 1012, and pump 1013. The hydraulic circuit 1000 is configured to move the port drive 1014 relative to the starboard drive 1015.

As shown in FIG. 10, port steering valve 1008 ("valve") is fluidically coupled to the port steering actuator 1002 ("first steering actuator") through counterbalance valves 1006*c* and 1006*d*. Port steering valve 1008 is also fluidically coupled to tie-bar actuator 1001 through counterbalance valves 1006*e* and 1006*f*. The hydraulic circuit 1000: (1) fluidically actuates the port steering actuator 1002 and moves the port drive 1014 using port steering valve 1008; and (2) fluidically actuates the tie-bar actuator 1001 using the port steering valve 1008 simultaneously with (1).

Starboard steering valve 1009 ("second valve") is fluidically coupled to the starboard steering actuator 1005 ("second steering actuator") through counterbalance valves 1006*i* and 1006*j*. Starboard steering valve 1009 is fluidically coupled to tie-bar actuator 1001 through counterbalance valves 1006*g* and 1006*h*. The hydraulic circuit 1000: (1) fluidically actuates the starboard steering actuator 1005 and moves the starboard drive 1015 using starboard steering valve 1009; and (2) fluidically actuates the tie-bar actuator 1001 using the starboard steering valve 1009 simultaneously with (1). The hydraulic circuit 1000 is configured to simultaneously actuate the port steering actuator 1002, the starboard steering actuator 1005, and the tie-bar actuator 1001.

As shown in FIG. 10, pump 1013 is fluidically coupled to port steering actuator 1002 and to the tie-bar actuator 1001. The hydraulic circuit 1000: (1) fluidically actuates the port steering actuator 1002 and moves the port drive 1014 using the pump 1013; and (2) fluidically actuates the tie-bar actuator 1001 using the pump 1013 simultaneously with (1).

In the particular implementation of FIG. 10, in the locked state the hydraulic fluid is locked in the tie-bar actuator 1001 by means of counterbalance valves 1006*a*-1, and the tie-bar actuator 1001 behaves similar to a conventional tie-bar, whereby the port drive 1014 and starboard drive 1015 are maintained in a fixed relationship relative to each other. When one or both drives are to be moved relative to the other, pressurized fluid is delivered by pump 1011 and/or pump 1013 to one side of the piston in tie-bar actuator 1001 via port steering valve 1008 and/or starboard steering valve 1009, as the case may be, while fluid on the other side of the piston is allowed to escape back to reservoir 1012.

The hydraulic system shown in FIG. 10 is one example of how an electro-hydraulic control system could be adapted to integrate the use of an active electro-hydraulic tie-bar system. In the example shown in FIG. 10, the working ports (A & B) of steering valves 1008 and 1009 are also connected to the tie-bar actuator 1001 (in addition to the steering actuators 1002 and 1005) through two dedicated sets of counterbalance valves. The cylinder-sideports (A3 & B3 for STBD and A4 & B4 for PORT) of the dedicated tie-bar counterbalance valves are then ported to the tie-bar actuator 1001 such that actuating a single steering actuator (port or starboard) via the respective steering valve will also actuate the tie-bar actuator 1001 in the correct direction and not affect the steering actuator that is not being actuated. The circuit in FIG. 10 will also allow both steering valves and corresponding actuators to be actuated simultaneously. The circuit illustrated in FIG. 10 is one example of a hydraulic circuit designed to actuate the active tie-bar system. It is to be appreciated that various alterations, modifications, and improvements of the example shown in FIGS. 8A-C and FIG. 10 will occur to those skilled in the art. For example, other embodiments of the active tie-bar may incorporate any device that can generate a suitable force, including but not limited to hydraulic cylinders, electrically-actuated power screws, pneumatic actuators, electromechanical devices, geared mechanisms, etc., and it is understood that any number of configurations within a given class of actuator may be adopted. Such alterations, modifications, and improvements are intended to be part of this disclosure and are intended to be within the scope of the system disclosed herein. One skilled in the art can modify the circuit in numerous ways, for example, by incorporating different types of valves and porting to perform the same function.

Figure 11A:
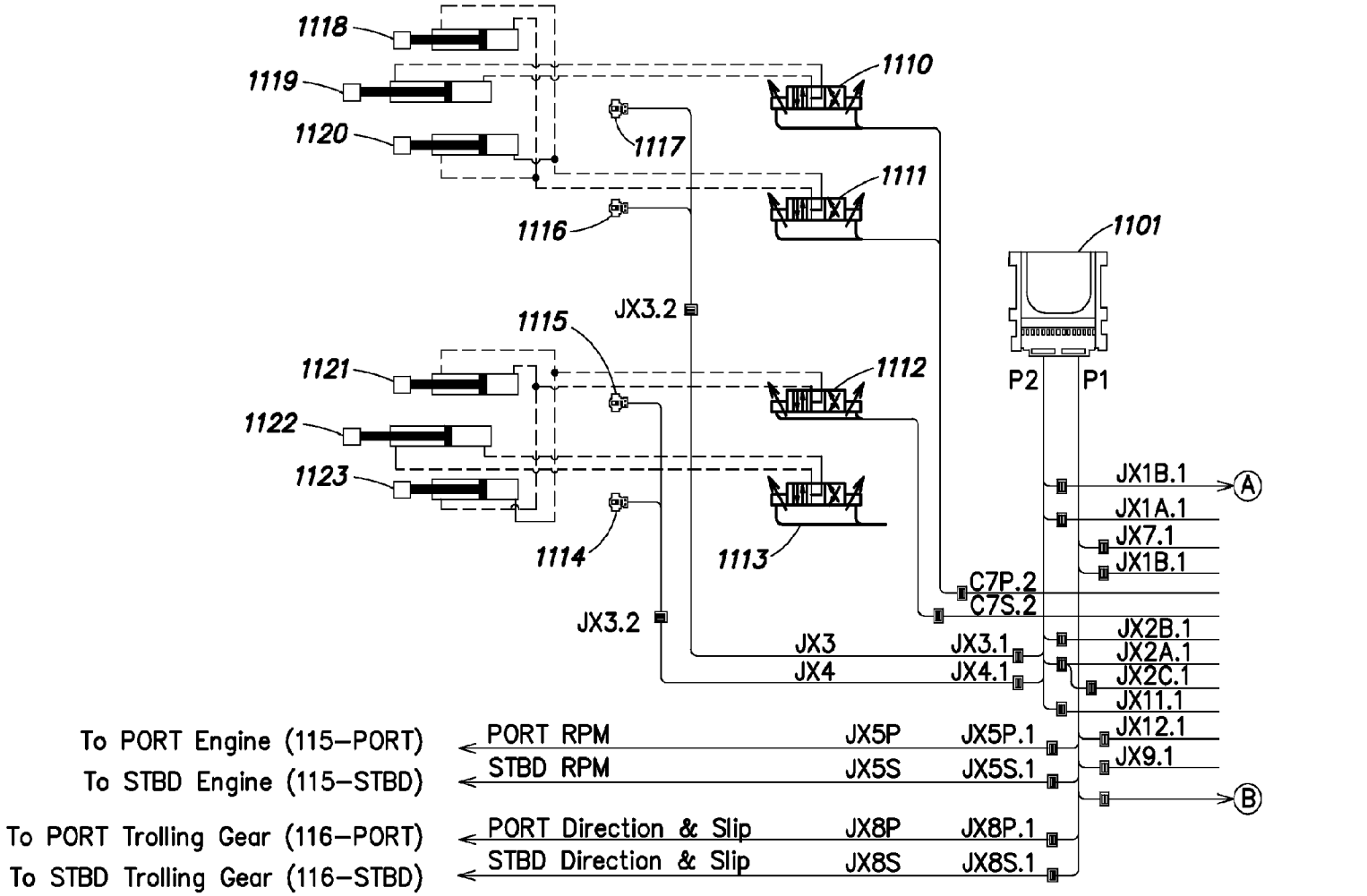
FIG. 11 illustrates an embodiment of a control system that can be used with the hydraulic variable length tie-bar of FIG. 9.
Figure 11B:
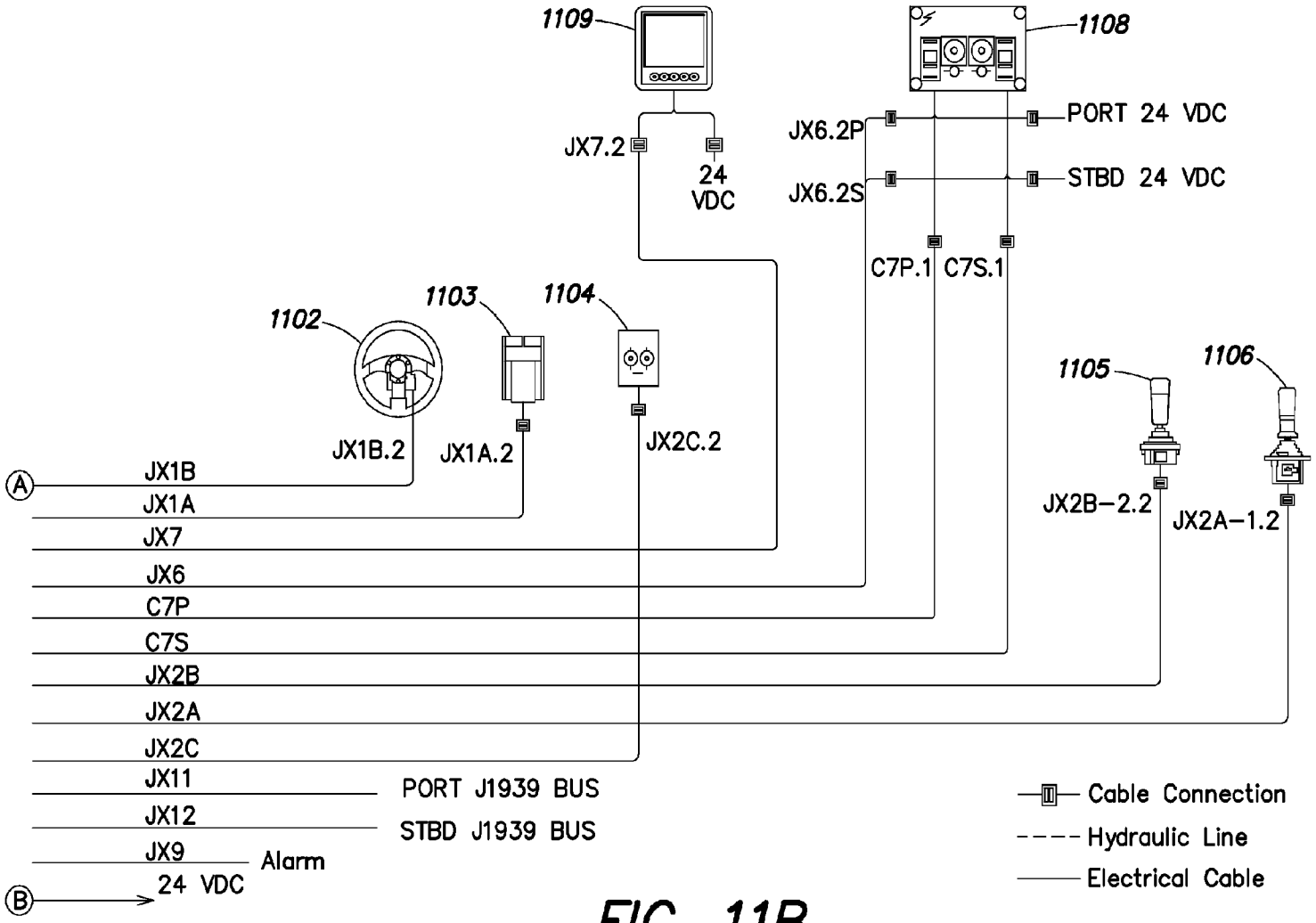

By way of example, FIG. 11 illustrates one embodiment of a system diagram for the device and embodiments thereof described herein.

Figure 12:
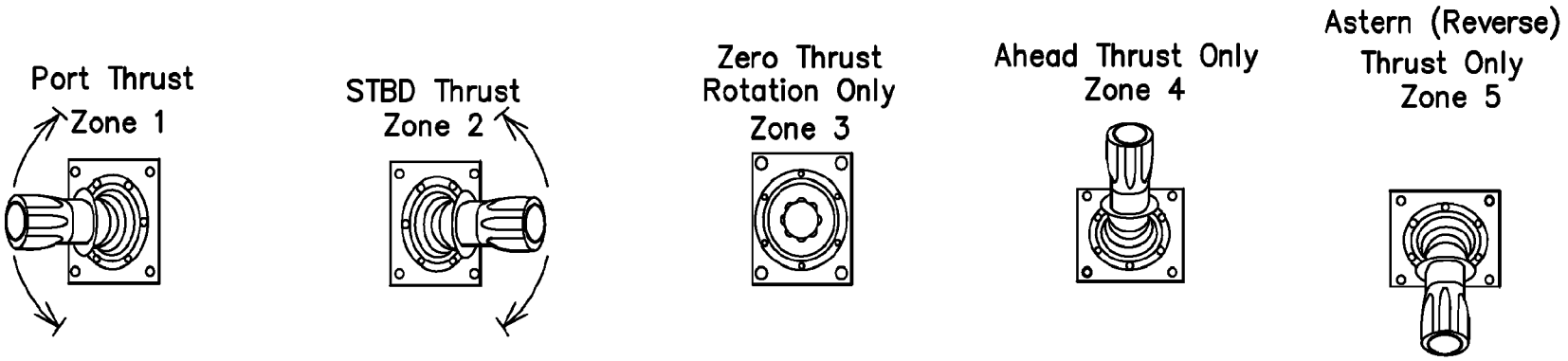
FIG. 12 illustrates various joystick control zones and movements.
Figure 13:
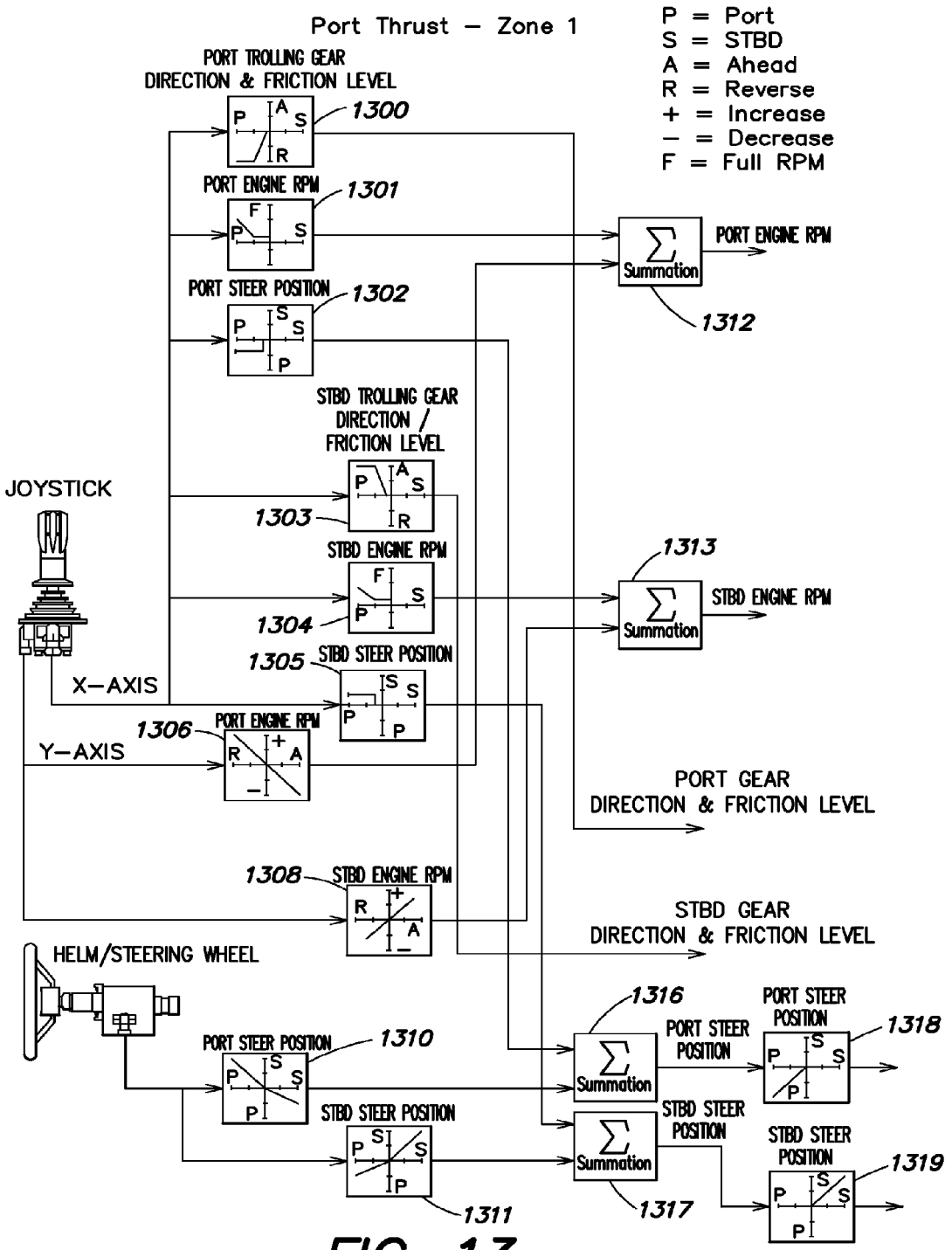
FIG. 13 illustrates an embodiment a control system and process for Zone 1 of the joystick controller of FIG. 12, which can be used with steerable propellers and a trolling gear.

One system and method of implementing a joystick control algorithm for a dual-drive system is to separate the control algorithms into five separate control zones as shown in FIG. 12, which are illustrated in more detail in FIGS. 13-17. By separating the algorithms into distinct zones, the difference in response characteristics of the steerable drive, for example between ahead and reverse thrust, can be compensated for by applying a different set of curves for the respective zones. One embodiment of such a system splits the control algorithms into five different zones that relate to the direction of applied net translational thrust: Port Thrust, Starboard Thrust, Zero Thrust (rotation only), Ahead Thrust Only (i.e., no side or reverse thrust) and Astern Thrust Only, as shown in FIG. 12. It is, of course, possible to utilize more or less than five zones, depending on the specific implementation of algorithms and function modules. However, the underlying goal is to create a system that compensates for the discontinuities in the force and motion created by the combination of propulsion devices, including characteristics of transmission gear and associated trolling gear (if available), in response to command or actuator inputs, for example, by changing the steering position mapping to steering wheel inputs when transitioning from ahead thrust (Zone 4) to astern thrust (Zone 5).

FIGS. 13-17 contain example algorithms for Zones 1-5 respectively. Because the effects of the propeller thrust contribute to the net translation and rotational thrust in different ways depending on the direction of net translational thrust (zone), each zone has a dedicated algorithm such that the controller automatically updates the algorithm when transitioning from one zone to another. Each zone-specific algorithm contains a different mapping that relates the control devices (e.g., joystick and steering wheel) to the propulsion devices (e.g., steerable drive, transmission gear and associated trolling gear, engine RPM). For example, when thrusting ahead with no side thrust (Zone 4, FIG. 16), modules 1656 and 1657 turn the drives in the starboard direction when the helm is turned to starboard (CW). In contrast, when thrusting astern with no side thrust (Zone 5, FIG. 17), modules 1750 and 1751 turn both drives to port when the helm is turned to starboard (CW).

FIG. 5A contains a maneuvering diagram (or Net Thrust Diagram) that illustrates a plurality of thrust forces for a plurality of controller conditions, that are provided to a vessel configured with the herein described embodiment of a system and that is equipped with two steerable drives. For example, the resulting forces imparted to the vessel for a starboard turn when thrusting ahead is shown as maneuver C. In addition, the resulting forces imparted to the vessel where the steering wheel is turned to starboard and while the craft is reversing is shown as maneuver O. By comparing maneuvers C and O, one can see that in order to maintain a clockwise rotation (bow moving in the starboard direction) as commanded by the steering wheel (or steering tiller), the drives must be pointing in the starboard direction when thrusting ahead and in the port direction when thrusting astern.

Referring again to FIG. 5A, the response of a vessel configured according to the herein described embodiment of a system and equipped with dual steerable propellers to CCW rotations of the wheel or tiller is shown in maneuvers A (thrusting ahead) and M (thrusting astern), respectively. It is to be appreciated that the movements of the drives are similar to the CW turning maneuver; however, the drives turn in opposite directions, as shown in modules 1656 and 1657 for Zone 4 and modules 1750 and 1751 for Zone 5.

Figure 15:
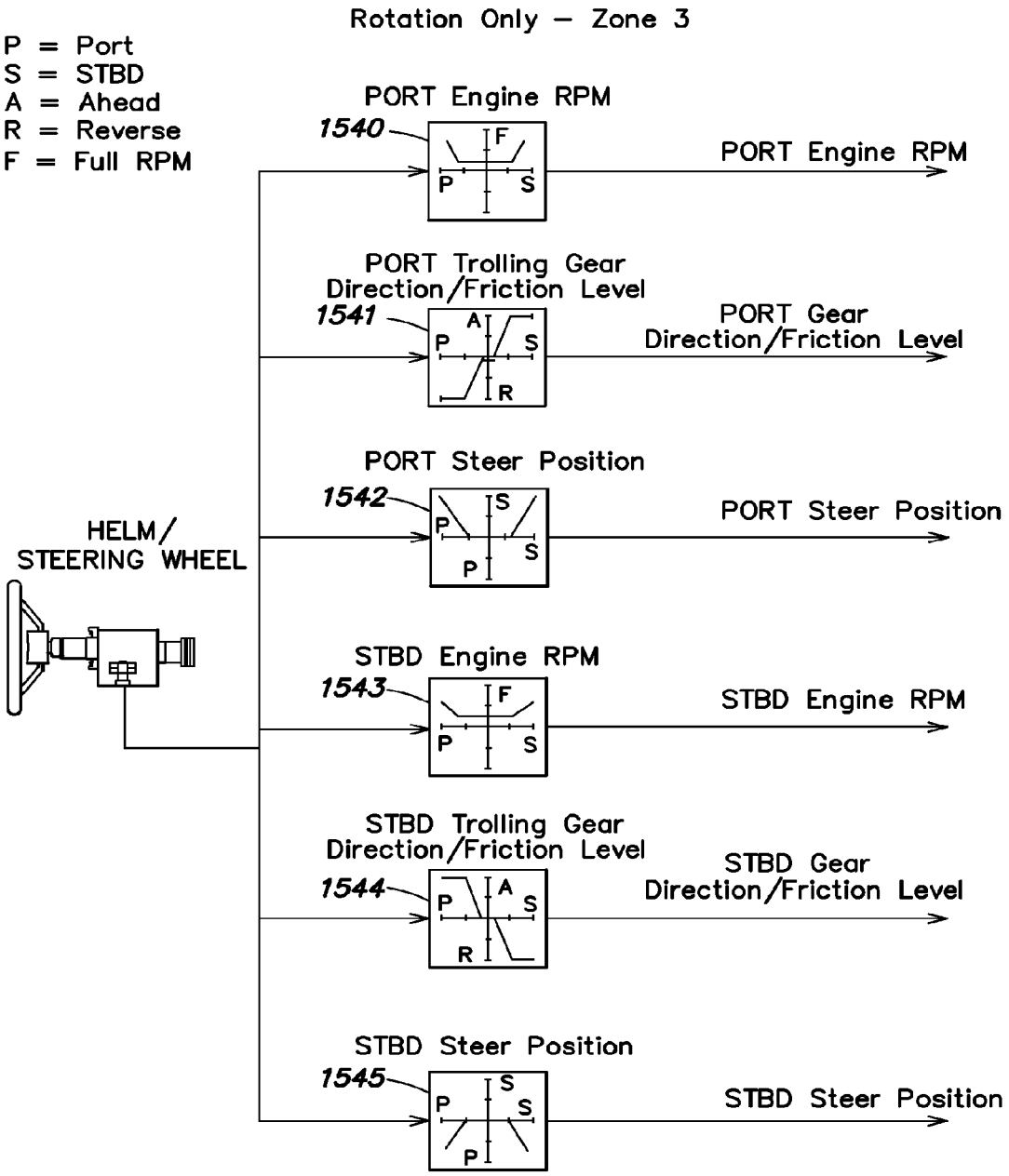
FIG. 15 illustrates an embodiment a control system and process for Zone 3 of the joystick controller of FIG. 12, which can be used with steerable propellers and a trolling gear.
Figure 16:
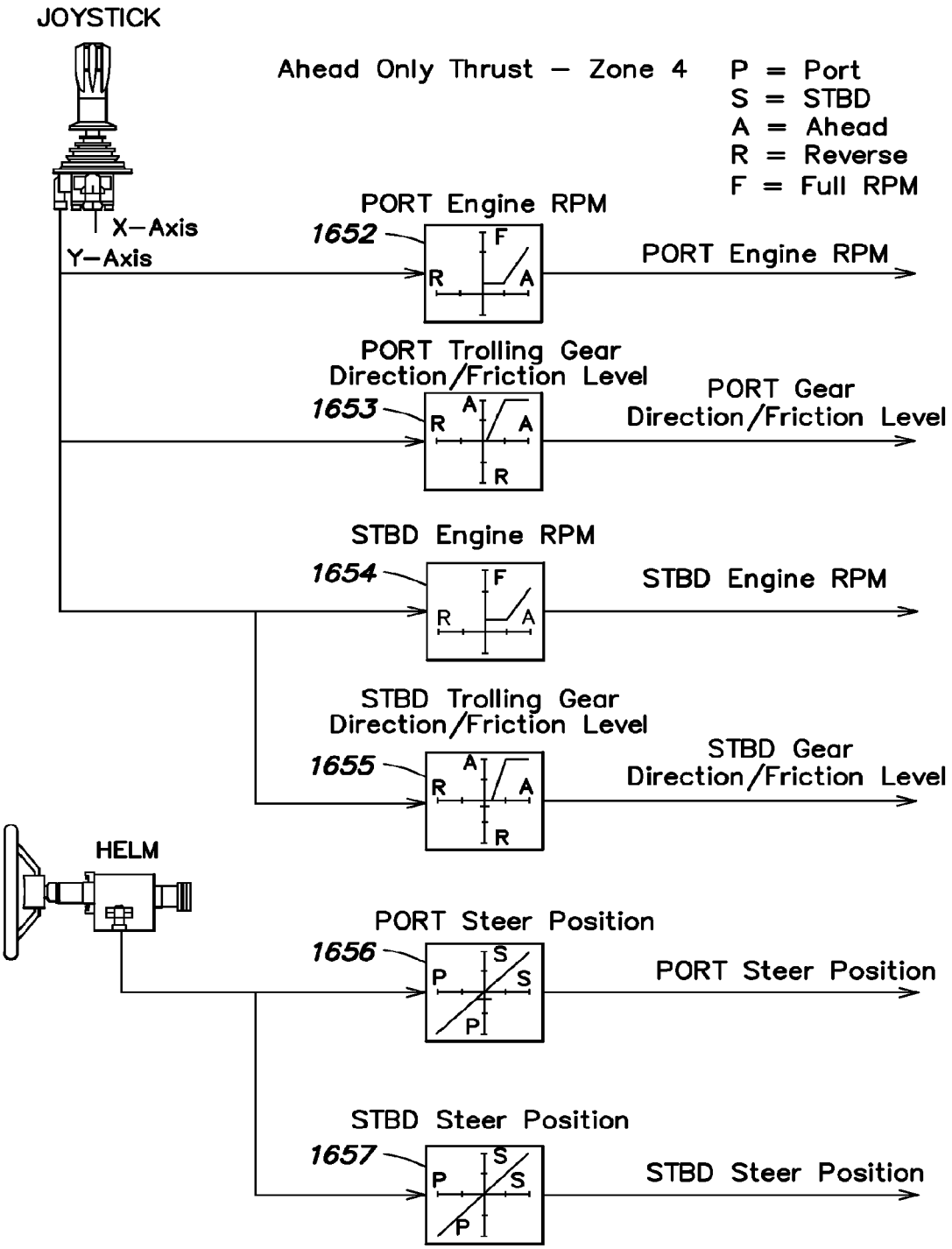
FIG. 16 illustrates an embodiment a control system and process for Zone 4 of the joystick controller of FIG. 12, which can be used with steerable propellers and a trolling gear.
Figure 17:
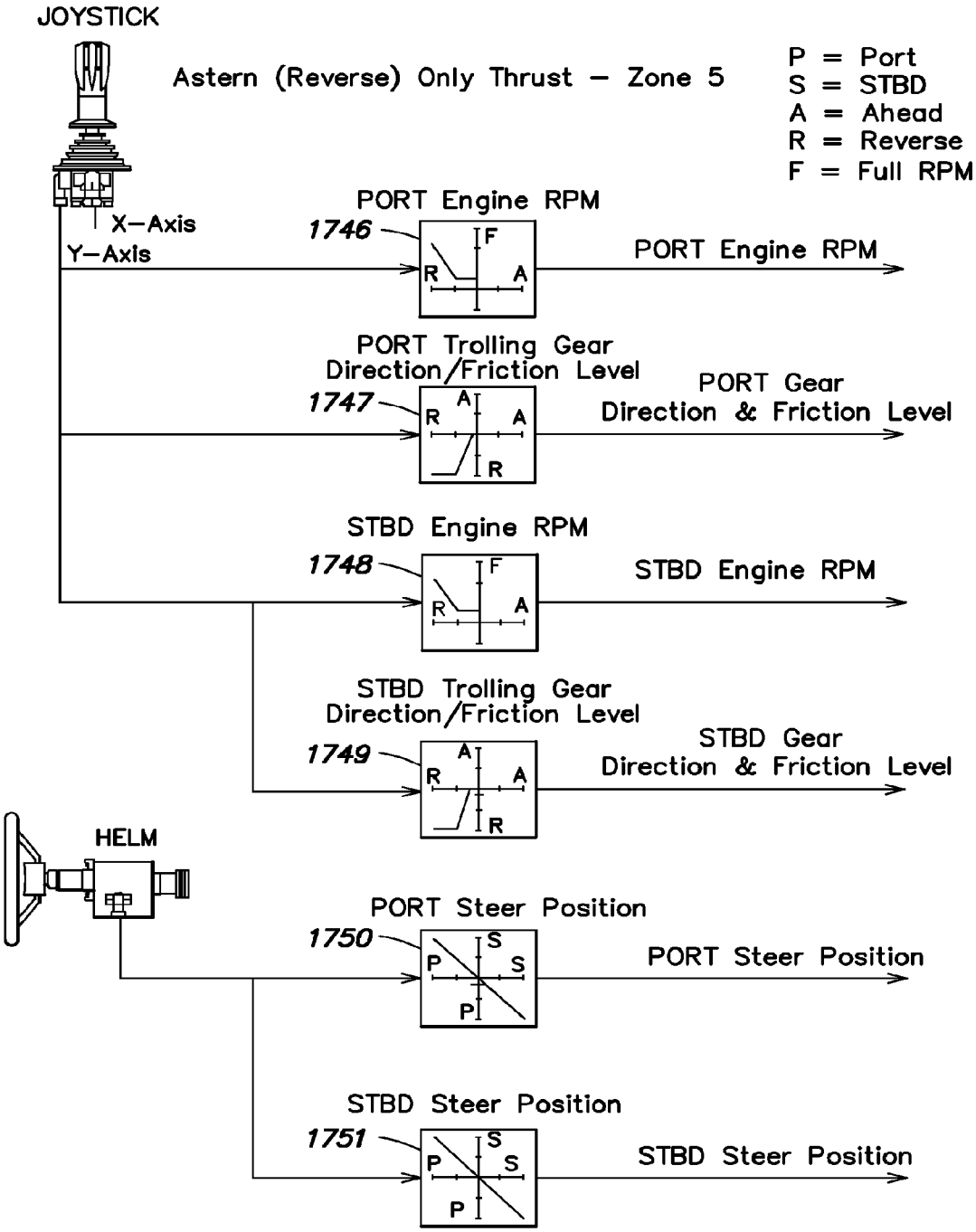
FIG. 17 illustrates an embodiment a control system and process for Zone 5 of the joystick controller of FIG. 12, which can be used with steerable propellers and a trolling gear.

Another example of control/propulsion device mapping to be considered is the case where there is no net translational thrust (i.e., only rotational thrust, Zone 3). A vessel equipped with dual steerable drives is not able to develop a turning moment by rotating the drives while at neutral thrust. Consequently, a special algorithm or mapping for the individual drives when no translational thrust is commanded such that the drives can operate independently to develop the turning moment. FIG. 15 shows a signal diagram for Zone 3 of the herein described embodiment of a system. It is to be appreciated that since the condition for Zone 3 is zero translational thrust, the joystick inputs have been omitted from the diagram for simplification.

To operate in Zone 3, a control scheme must be implemented where the drives are operated differentially, where one drive is generating ahead thrust and the other is generating astern thrust in order to impart little or no net translational thrust to the craft. FIG. 15 illustrates an effective method for developing rotational thrust with little or no translational thrust. Taking for example maneuver F shown in FIG. 5A, the wheel is turned to starboard while the joystick is centered. With a trolling gear on the transmission, Module 1541 (FIG. 15) progressively increases the port gear setting to achieve progressively increasing propeller speed in the ahead direction, while module 1544 progressively increases the starboard gear setting to achieve progressively increasing propeller speed in the astern direction creating a force couple (moment) without creating a substantial net translational thrust. Since the amount of turning force created by the differential thrust of the drives is limited while the drive steering positions are maintained in a parallel orientation at zero steer angle, additional turning of the wheel will progressively turn the port drive in the starboard direction (module 1542) and the starboard drive in the port direction (module 1545). Increasingly toeing-in (pointing) the drives will increase the moment arm of the resultant force created by the two drives significantly while applying a relatively small side force. In addition to actuating the propeller shaft speed differentially and toeing in the drives, modules 1540 and 1543 progressively increase engine RPM once the wheel or tiller is moved beyond a threshold point. Thus according to this embodiment of the system disclosed herein, the system provides rotation forces with little or no translation forces by progressively pointing in the steerable propellers and/or applying a differential RPM to the drives as a function of wheel or tiller rotation. However, it is to be understood that the exact combination of trolling gear settings, steering angle movements, and engine RPM levels shown in the embodiment in FIG. 5A is not required to achieve the same or similar results. For example, the engine RPM can be increased at different points in the mapping or not at all with varying levels of effectiveness. In addition, the extent of toeing in the drives can be changed or eliminated, also with varying levels of effectiveness.

Vessels equipped with steerable propellers are able to induce combinations of transverse and rotational thrusts that will allow the craft to translate sideways while at the same time apply varying amounts of rotational thrust. As another example, referring to Zone 1 (thrusting to port) in FIG. 5A, an example maneuver in which a transverse thrust is applied to the craft without a rotational thrust is identified as maneuver H. The required actuation of the trolling gear, steering angles and engine RPM to achieve maneuver H can be determined from the control diagram of FIG. 13.

Let us first consider the case of maneuver H where the craft is translating sideways with little or no forward or reverse thrust. In this case, the initial condition is maneuver E (Zone 3), in which the joystick is centered (neutral X and neutral Y) and the steering wheel is centered; in this condition, both transmissions will be set to neutral, in accordance with the signals created by the joystick and transmitted to modules 1300 and 1303. As the X-axis signal is increased beyond the threshold that transitions from Zone 3 to Zone 1, the port drive steering angle is positioned (by module 1302) in a discrete position in the port direction and the starboard steering angle is positioned (by module 1305) in a discrete position in the starboard direction. The respective positions of the port and starboard drives correspond to the equilibrium point where translational thrust can be applied in any direction without inducing a substantial rotational or yawing force. These positions usually correspond to angles where both drives are pointed along respective center lines that intersect at or near the center of rotation of the craft. Drives that are positioned in this manner are sometimes referred to as being in a toe-out configuration. As long as the steering wheel remains in a neutral position that corresponds to no rotational thrust, both drives will remain in these respective discrete positions.

As illustrated by modules 1300 and 1301, progressively moving the joystick to increase the magnitude of net transverse thrust in the port direction will increase the trolling gear setting (increase in friction level) in the astern direction and increase the RPM of the port engine (not necessarily together), thereby increasing the reverse thrust of the port drive. At the same time, moving the joystick to port will increase the trolling gear setting in the ahead direction and increase the RPM of the starboard engine, thereby increasing the ahead thrust of the starboard drive. As long as the joystick is moved along the X-axis only (i.e., neutral Y position), the reversing thrust of the port drive and the ahead thrust of the starboard drive will remain substantially equal in magnitude so as to induce a net transverse thrust without imparting a net forward or reverse thrust.

Adding a rotational thrust in the port or counter-clockwise direction (maneuver G of FIG. 5A) is achieved by rotating the steering wheel in the counter-clockwise direction. As indicated by modules 1310 and 1311, moving the steering wheel to port (CCW) will move the port drive in the starboard direction and the starboard drive in the port direction. This is achieved by creating an additional starboard movement with module 1310 for the port drive based on the magnitude of the wheel rotation and adding it to the discrete position output from module 1302 at summing module 1316. Similarly, an additional port movement is added to the starboard drive by module 1311 and summed with the discrete output of module 1305 at summing module 1317. So as not to create a situation where the drives are allowed to move to a point beyond the neutral position such that the direction of translational thrust differs substantially from the joystick movement, absolute limits are placed on the steering movements with module 1318 for the port drive and module 1319 for the starboard drive. Module 1318 will not allow the port drive to move to the starboard side of neutral (straight ahead) and module 1319 will not allow the starboard drive to move to the port side of neutral. It is to be appreciated, however, that for cases in which there is not enough rotational thrust available in one direction as provided by the system described herein, the limits set by modules 1318 and 1319 can be extended.

It is to be understood that the magnitude of the steering angles of the port and starboard drives in response to steering wheel movements need not be the same, provided there are minimal changes in translational thrust resulting from movements of the steering wheel or tiller. The optimum amounts of steering angle movement for each drive in response to steering commands depends heavily on the hydrodynamics of the craft during side thrusting operations as well as the hull-propeller interactions for each drive. These points can be estimated with application-specific modeling or determined during a sea trial.

Figure 14:
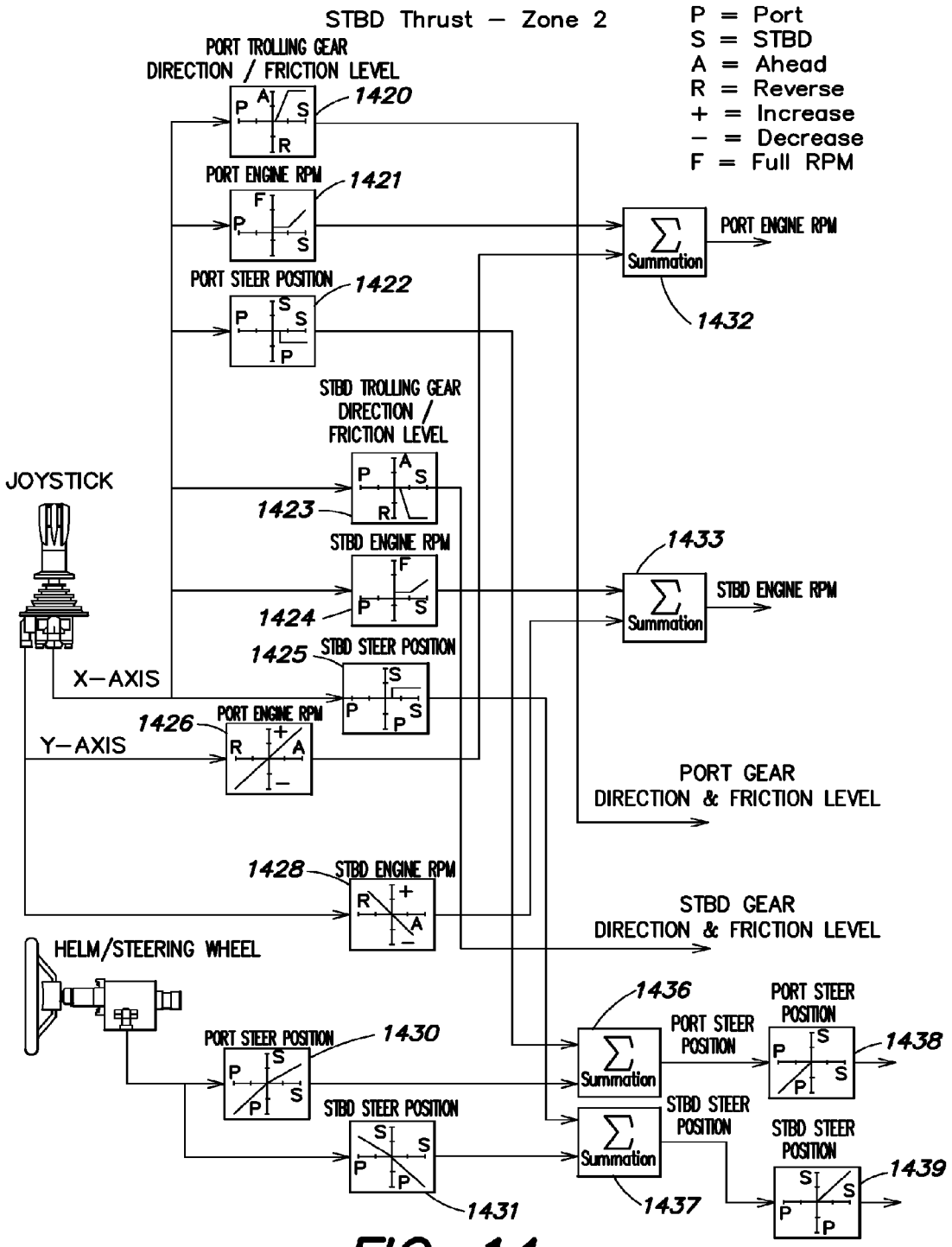
FIG. 14 illustrates an embodiment a control system and process for Zone 2 of the joystick controller of FIG. 12, which can be used with steerable propellers and a trolling gear.

It is understood that Zone 2 of FIG. 5A is substantially a minor image of Zone 1, and therefore the corresponding modules of FIG. 14 and the resulting maneuvers J, K and L illustrated in FIG. 5A will not be discussed in detail here, for the sake of brevity.

As shown in FIG. 12, Zones 1 and 2 cover all movements of the joystick to the respective side of neutral (with respect to transverse thrust). Accordingly, the control algorithms described in FIG. 13 for Zone 1 and FIG. 14 for Zone 2 also are configured to add varying levels of ahead and astern thrust in response to joystick movements along the Y axis in order to respond to diagonal translational thrust commands from the joystick. For example, referring now to FIG. 5B, which illustrates movements of a vessel configured with the control system of one embodiment of the invention and equipped with dual steerable propellers, maneuver Q can be achieved by maintaining the steering wheel at a neutral position such that modules 1310 and 1311 (of FIG. 13) do not contribute additional steering movements to the summation modules (1316, 1317) and by moving the joystick forward in addition to the port direction. As the joystick is moved forward along the Y axis, module 1306 of FIG. 13 progressively decreases the port engine RPM and module 1308 progressively increases the starboard engine RPM, thereby decreasing the astern thrust of the port drive and increasing the ahead thrust of the starboard drive. This maneuver is illustrated as maneuver Q in FIG. 5B, by schematically indicating the reduction of thrust in the port drive and the increase in thrust of the starboard drive.

In a similar fashion as maneuvers G and I illustrated in FIG. 5B, a rotational thrust to port (CCW) can be added by turning the wheel counter clockwise, thereby moving the drives towards the center as shown in maneuver P of FIG. 5B. Similarly, a clockwise rotational thrust can be achieved by turning the wheel to starboard which will move the drives away from the center, as shown in maneuver R (FIG. 5B).

Like the forward diagonal movements of maneuvers Q and R in FIG. 5B, reverse diagonal thrust can be developed by moving the joystick backward along the Y axis. For example, by maintaining the steering wheel and moving the joystick backwards, module 1306 increases the astern thrust of the port drive and module 1308 decreases the ahead thrust of the starboard drive. This diagonal backwards and to port maneuver is illustrated as maneuver T of FIG. 5B. In a similar fashion as maneuvers G and I, a rotational thrust to port (CCW) can be added by turning the wheel counter clockwise, thereby moving the drives towards the center as shown in maneuver S of FIG. 5B. Similarly, a clockwise rotational thrust can be achieved by turning the wheel to starboard which will move the drives away from the center (i.e., drives splayed), as shown in maneuver U of FIG. 5B.

It is understood that Zone 2 of FIG. 5A is substantially a minor image of Zone 1, and therefore the corresponding modules of FIG. 14 will not be discussed in detail here for the sake of brevity.

It is to be understood that the summation modules herein described and illustrated can sum the various signals in different ways. For example, different signals may have different weights in the summation or selected signals may be left out of the summation under certain conditions. It is also the function of the summation module to clamp (limit) output signals that would otherwise exceed maximum values.

It is to be understood also that the port trolling gear module illustrated in FIGS. 13-17, according to the herein described embodiment of a system equipped with two steerable propellers, can be separated into two distinct modules to handle direction and friction level, respectively, for the port transmission. It is understood that the foregoing statement applies to the starboard trolling gear module.

Having described various embodiments of a marine vessel control system and method herein, it is to be appreciated that the concepts presented herein may be extended to systems having any number of control surface actuators and propulsors and is not limited to the embodiments presented herein. Modifications and changes will occur to those skilled in the art and are meant to be encompassed by the scope of the present description and accompanying claims. It is, therefore, to be understood that the appended claims are intended to cover all such modifications and changes as fall within the range of equivalents and disclosure herein.

What is claimed is:

1. A control system for use with a watercraft having a first drive, a second drive, a first steering actuator configured to actuate the first drive, and a second steering actuator configured to actuate the second drive, the control system comprising:

a tie-bar actuator configured to be coupled to the first drive and to the second drive; and a hydraulic circuit that moves the first drive relative to the second drive, the hydraulic circuit comprising a valve fluidically coupled to the first steering actuator and the tie-bar actuator, wherein the hydraulic circuit:

(1) fluidically actuates the first steering actuator and moves the first drive using the valve, and (2) fluidically actuates the tie-bar actuator using the valve simultaneously with (1).

2. The control system of claim 1, wherein the hydraulic circuit further comprises a second valve fluidically coupled to the second steering actuator and the tie-bar actuator.

3. The control system of claim 2, wherein the hydraulic circuit is configured to simultaneously actuate the first steering actuator, the second steering actuator, and the tie-bar actuator.

4. The control system of claim 1, wherein the hydraulic circuit comprises a plurality of steering valves and a plurality of counterbalance valves different from the plurality of steering valves.

5. The control system of claim 1, wherein the hydraulic circuit fluidically actuates the tie-bar actuator by generating tension and/or compression forces within the tie-bar actuator.

6. The control system of claim 1, wherein the tie-bar actuator actively extends or retracts in response to being fluidically actuated by the hydraulic circuit.

7. The control system of claim 1, further comprising a pump that fluidically actuates the tie-bar actuator.

8. A control system for use with a watercraft having a first drive, a second drive, a first steering actuator configured to actuate the first drive, and a second steering actuator configured to actuate the second drive, the control system comprising:

a tie-bar actuator configured to be coupled to the first drive and to the second drive; and a hydraulic circuit that moves the first drive relative to the second drive, the hydraulic circuit comprising a pump fluidically coupled to the first steering actuator and the tie-bar actuator, wherein the hydraulic circuit:

(1) fluidically actuates the first steering actuator and moves the first drive using the pump; and (2) fluidically actuates the tie-bar actuator using the pump simultaneously with (1).

9. The control system of claim 8, wherein the hydraulic circuit further comprises at least one valve, and the hydraulic circuit fluidically actuates the first steering actuator and moves the first drive using the at least one valve, and fluidically actuates the tie-bar actuator using the at least one valve.

* * * * *